United States Patent [19]

Tabuchi et al.

[11] 4,338,880

[45] Jul. 13, 1982

[54] MAGNETIC BRUSH DEVELOPMENT APPARATUS FOR USE IN ELECTROPHOTOGRAPHIC COPYING MACHINE

[75] Inventors: Kenji Tabuchi; Susumu Tanaka; Kenichi Wada; Tateki Oka, all of Sakai, Japan

[73] Assignee: Minolta Camera Kabushiki Kaisha, Osaka, Japan

[21] Appl. No.: 74,812

[22] Filed: Sep. 11, 1979

[30] Foreign Application Priority Data

| | | | |
|---|---|---|---|
| Sep. 19, 1978 | [JP] | Japan | 53-115252 |
| Sep. 19, 1978 | [JP] | Japan | 53-115253 |
| Sep. 19, 1978 | [JP] | Japan | 53-115254 |
| Sep. 19, 1978 | [JP] | Japan | 53-115377 |

[51] Int. Cl.[3] ..... G03G 15/09

[52] U.S. Cl. ..... 118/652; 118/657; 355/3 DD

[58] Field of Search ..... 118/657, 652, 658; 430/122, 125; 355/3 DD

[56] References Cited

U.S. PATENT DOCUMENTS

| | | | |
|---|---|---|---|
| 3,645,770 | 2/1972 | Flint | 430/122 X |
| 3,682,538 | 8/1972 | Cade et al. | 118/652 X |
| 3,918,402 | 11/1975 | Ohta | 118/654 X |
| 3,926,516 | 12/1975 | Whited | 355/3 DD |
| 4,081,571 | 3/1978 | Nishiyama et al. | 118/653 X |
| 4,161,923 | 7/1979 | Abbott et al. | 118/658 |
| 4,194,465 | 3/1980 | Tsukamoto et al. | 118/658 |
| 4,235,194 | 11/1980 | Wada et al. | 118/657 |

*Primary Examiner*—Evan K. Lawrence

*Attorney, Agent, or Firm*—Wenderoth, Lind & Ponack

[57] ABSTRACT

A magnetic brush developing apparatus for use in an electrophotographic copying machine for developing an electrostatic image and utilizing a developer which is constituted by non-magnetic particles and magnetic particles. The apparatus includes a rotatable multipole magnetic member within a rotatable developing sleeve for transporting developing material affected by the magnetic member in a direction opposite the direction of rotation of the sleeve, at least one cleaning member for removing part of the developer which is at most only slightly affected by the magnetic member and transported in the direction of rotation of the sleeve, and at least one resilient scraping member for scraping the affected developer from the surface of the sleeve and being sufficiently resilient to allow the slightly affected developer material to pass between the scraping member and the sleeve so as to avoid buildup of the slightly affected developer between the scraping member and the sleeve.

15 Claims, 14 Drawing Figures

MAGNETIC BRUSH DEVELOPMENT APPARATUS FOR USE IN ELECTROPHOTOGRAPHIC COPYING MACHINE

BACKGROUND OF THE INVENTION

This invention relates to an apparatus for developing an electrostatic latent image, which has been generally employed in the field of electrophotography, and, more particularly, to a magnetic brush development apparatus for use therein.

Conventionally, as far as a developer to be used for the above-described field is concerned, two component developers such as a mixture constituted by magnetizable carrier particles, for example, iron particles, each having a relatively larger particle-diameter (an approximate particle-diameter of 75 μm) and non-magnetizable particles, or one component developers employing magnetizable toner particles and the like are well known in the art. The respective developers inherently have a number of advantages and, have been put into practical application up to the present. Hence, recently, in order to further improve the above-described developers thereby to provide them with much enhanced characteristics, there has already been carried out considerable research, resulting in providing somewhat different novel developers. More specifically, there have been proposed the following two component developers respectively constituted by two components of magnetizable particles and non-magnetizable particles having approximately the same particle diameters with respect to each other, for instance, in U.S. patent application Ser. No. 863,616, filed Dec. 23, 1977, in which a developer constituted by magnetizable toner and electrically insulating non-magnetizable toner at a predetermined mixing ratio by weight is employed for the developer, and also in U.S. patent application Ser. No. 949,426, filed Oct. 5, 1978, in which there is employed a developer constituted by insulating toner particles and carrier granules having the properties of (1) being magnetic, (2) having a high electro-resistivity (more than $10^{12}$ Ω·cm), and being 5 to 40 μm in size.

Actually, although the respective, improved two component developers described above are principally capable of being used in a conventional magnetic brush development apparatus without any important modification, some properties of the recently improved two-component developers mentioned above are a little different from those inherently belonging to the conventional developers. Therefore, so far as the recently improved developers are employed for the developing process, the magnetic brush development apparatus itself should be arranged to be especially useful for the improved developers. Due to the practical demand as described above, some of the present inventors have proposed a magnetic brush development apparatus, which has been described in FIG. 1 of U.S. patent application, Ser. No. 16,610, filed Mar. 1, 1979, patent No. 4,235,194, and has the following construction.

Referring now to FIG. 1, there is shown a dry process developing apparatus 5 according to one preferred embodiment of the application mentioned above, which generally includes a housing 10 extending the width of a known photoreceptor 1 in the form of a drum and substantially enclosed except for an opening 10*b* adjacent to the photosensitive or photoreceptor surface 1*a* of the photoreceptor 1 whereat the development of electrostatic latent images formed on the photoreceptor surface 1*a* is effected, an outer cylinder or developing sleeve 6 rotatably provided in the housing 10 adjacent to the photoreceptor surface 1*a*, a rotary magnet or multipolar magnet member 7 rotatably enclosed in the developing sleeve 6, a developer- or developing material stirring device 20 provided in the housing 10, and a developing material supplying device or toner dispenser C disposed above the developing material stirring device 20 for replenishing toner into the developing apparatus 5 in a known manner.

The developing sleeve 6 of cylindrical configuration made of non-magnetizable electrically conductive material such as aluminum is disposed for rotation counterclockwise at approximately 30 r.p.m. in a position close to the surface 1*a* of the photoreceptor 1 which is also capable of rotating counterclockwise. The multipolar magnet member 7 of roll-like configuration has magnetic poles N and S sequentially arranged around its outer periphery and alternating as shown and is adapted to rotate at a speed of 2000 r.p.m. in the same direction as the developing sleeve 6. More specifically, on the assumption that the developing sleeve 6 has a diameter of 31 mm, the developer obtains a moving speed of approximately 10 cm/sec. in the clockwise direction through rotation of the multipolar magnet member 7, and also a moving speed of approximately 5 cm/sec. in the counterclockwise direction through rotation of the developing sleeve 6, and is consequently moved along the surface of the developing sleeve 6 at a speed of approximately 5 cm/sec. in the clockwise direction.

Meanwhile, at a lower portion of the developing sleeve 6, scraper members or scraping plate members 17 and 18 made of non-magnetizable resilient material, for example, suitable synthetic resin, thin metallic pieces, etc. are fixed to a support shaft 17*a* for sliding contact with the peripheral surface of the developing sleeve 6 in directions opposite to and the same as the direction of rotation of the developing sleeve 6.

The developer is successively transported up to a position A whereat it is affected by the moving force arising from rotation of the multipolar magnet member 7, through trough-like members 30 provided around peripheral edges of rotary edges of rotary discs 29*a* and 29*b* for the developing material stirring device 20, and from the position A, is moved along the surface of the developing sleeve 6 at the speed of approximately 5 cm/sec. in the clockwise direction, with the amount being restricted by a doctor blade 13*a* provided above and adjacent to the surface of the developing sleeve 6. After once being collected in a developing material collecting zone Q formed between the developing sleeve 6 and photoreceptor 1, the developer is rubbed against the electrostatic latent image preliminarily formed on the photoreceptor surface 1*a* for developing the latent image.

In the above case, since the developer is subjected to the moving force and disturbed owing to rotation of the developing sleeve 6 even in the zone P which is comparatively widely spaced from the developing sleeve 6 in the developing material collecting zone Q, hardening or solidification of the developer at the zone P is advantageously prevented, which is mainly attributed to the novel construction according to this prior application so arranged as to avoid compression of the developer between the developing sleeve 6 and photoreceptor 1.

The developing sleeve 6 has applied thereto a bias electrical potential, the prevailing polarity of which is arranged to be the same as that given by the electrostatic latent image, so that the surface of the photoreceptive drum is prevented from being fogged.

Impurities such as dust and dirt and the like mixed in the developing material, or developer itself, etc. solidified in the vicinity of the doctor blade 13*a*, which are not affected or only slightly affected by the moving force arising from rotation of the multipolar magnet member 7, are moved by the rotation of the developing sleeve 6 in a direction opposite to that of movement of the developer, i.e. counterclockwise, and scraped off the developing sleeve 6 by the scraping plate member 18 directed opposite to the direction of rotation of the developing sleeve 6. On the other hand, the developer remaining after the developing treatment is scraped off the developing sleeve 6 by the scraping plate member 17 directed in the same direction as the direction of rotation of the developing sleeve 6 for being returned into a developing material storage tank 8 of the developing material stirring device 20.

Still referring to FIG. 1, in a position above developing sleeve 6, a roll 105 is rotatably provided, with a slight clearance being maintained between the roll 105 and the surface 1*a* of the photoreceptor 1 for preventing dust from the developer from entering the interior of the copying machine (not shown). The roll 105 is provided, at opposite ends thereof, with rollers 106 each having a diameter slightly larger than that of the roll 105 and contacting corresponding ends of the photoreceptor drum 1 for simultaneous rotation with the photoreceptor 1 and also for proper positioning of the developing sleeve 6 with respect to the photoreceptor drum 1.

The developing apparatus described above has a number of advantages and, is an excellent apparatus for practical use. However, there are still problems involved in the employment of this improved developer constituted by a mixture of magnetizable particles and non-magnetizable particles in a developing apparatus of the above-described type. There is still not avoided the occurrence of a number of undesirable operational defects such as the occurrence of a cloud of dust from unused developer powder. Accordingly, there are still left a number of difficulties in the use of the recently improved developers of the above-described type in the developing apparatus specifically improved as described in the foregoing. More specifically, due to the unsolved difficulties in use of the developer of the above-described type in the developing apparatus described above, there in still often brought about undesirable behavior of the developer in the apparatus as well as a resultant quality-degradation of the developed image, which is mainly caused by the unused powder existing within the apparatus.

In order to overcome the difficulties involved in the use of the developers of the above-described type in the developing apparatus described above, the present inventors have found that the following points should be further improved in respect to the developing apparatus. As for the developers, two kinds which have already been disclosed in U.S. patent application Ser. Nos. 863,616 and 949,426 as described earlier, were employed for the experimental tests carried out.

With respect to the first point to be improved, according to the developing apparatus described above, owing to the occurrence of counterclockwise transportation of some developer as the developing sleeve 6 is rotated in a reverse direction with respect to that given in the course of the developing process, the developer, which has not been scraped off by the scraping plate member 18, is gradually, forcibly deposited between the surface of the developing sleeve 6 and the scraping plate member 17 and, thereby, there is brought about an undesirable depositing of coagulated developer.

With respect to the second point to be improved, there can be considered the defect which is due to the undesirable, free dispersion of the developer and its resultant powder, as described hereinbelow. When particular attention is directed to the part of the developing apparatus whereat the developer retained on the developing sleeve 6 is scraped off by the scraping plate member 17, the developer is brought into a free dispersed condition by a collision between the developer mentioned above and the scraping plate member 17, whereby a cloud of dust from unused powder thus produced is directly spread out either outside the developing apparatus itself or onto the surface of the photoreceptor surface, thereby resulting in generation of a number of undesirable phenomena. More specifically, a part of the dust from the unused powder is electrostatically adhered onto a right, approximate edge-portion of a casing constituting the developing material storage tank 8 in FIG. 1. Referring now to FIG. 2, there is shown a detailed view particularly showing the above-described electrostatic adhering characteristics of the developer. Although the magnetizable particles, which are negatively charged and retained on the peripheral surface of the developing sleeve 6 by means of magnetic force generated by the multipolar member 7, each have a rather small particle-diameter as well as small mass, respectively, the particles dispersed from the periphery as described above do not gravitationally fall, but rather tend to be electrostatically stuck to the edge-portion of the casing 8 due to an electrical potential gradient existing between the developing sleeve 6 and the casing 8 described above. The developing sleeve is maintained in an electrically negative state by impressing a bias electrical potential thereon, whereas the casing 8 is generally maintained at an electrical potential level of zero. Even if the casing or the developing material storage tank 8 is made of electrically-insulating materials such as synthetic resins and electrically-conductive materials such as aluminum, brass etc., occurrences of electrostatic adhering of the magnetizable particles can hardly be avoided. However, it has already been confirmed that the amount of the magnetizable particles adhering is much larger, when the casing is made of electrically-conductive material. Due to its relatively small particle-diameter and mass, each particle (the magnetizable particle) adhering to the right edge-portion of the casing 8 will not roll down along the inner surface of the casing, but rather large amount of the particles adhering to the surface described above are rolled up along the surface by the magnetic force caused by the multipolar magnet member 7, which is specifically indicated by an arrow in FIG. 2. Therefore, unless appropriate precautions are taken, an undesirable situation occurs in which the particles thus rolling up are discharged from the casing through a clearance existing between the casing 8 and the photoreceptor surface 1*a*. To overcome the undesirable situation as described above, as long as the edge-portion is made of electrically-conductive material and is further impressed with the biasing electrical potential thereby to cause it to be given an electrical potential the same level and polarity as that impressed on the developing sleeve 6, it may be possible to eliminate the electrical potential gradient prevailing between the developing sleeve 6 and the edge-portion of the casing 8. Such being the case, although the absolute amount of developer adhering to the edge-portion is naturally reduced, the complete elimination of the particle-adhesion can not be accomplished, whereby an undesirable dispersing of the developer through the clearance formed between the edge-portion of the casing 8 and the photoreceptive drum 1 is not still prevented. Furthermore, subject to the impression of electrical potential on the edge-portion of the casing 8, the magnetizable particles are electrostatically stretched back from the edge-portion of the casing 8 and thus, the magnetizable particles are in turn spread out in the space existing between the developing sleeve 6 and the edge-portion of the casing 8. Accordingly, the undesirable condition, in which the dust from unused particles thus dispersed adheres to the non-image bearing portion on the photoreceptor, will take place. Thus, as is clear from the description, the impression of the biasing electrical potential is not desirable. That is to say, as a result of the impression of the biasing electrical potential, the magnetizable particles each having a negative polarity will not adhere to the developing sleeve 6 and the edge-portion both having the same negative polarity, but will, on the contrary, adhere to the background portion of the latent image on the photoreceptor surface 1*a*, which has an electrical potential having the same polarity and at a much lower level in comparison with that of the biasing electrical potential described above. A further defect caused by the dust of the unused powder in the developing apparatus in FIG. 1 is the problem involved in transportation of the developer from the trough-like member 30 to the developing sleeve 6, and the following process wherein the photoreceptor surface 1*a* is rubbed by the developer thus transported, since they involve further possibilities of causing degradation of the quality of the copies image for a reason which will be described hereinbelow. As schematically shown in FIG. 3, the cloud of dust from the unused powder dispersed in the space enclosed by both upper shielding member C and the peripheral surface of the developing sleeve 6 will consequently adhere to the inner surface Ca of the shielding member C. Therefore, when the amount of coagulated particles thus adhering is beyond a certain amount, they are coagulated with respect to each other and then, fall and stick to the surface of the photoreceptive drum 1. Since the developer thus stuck to the surface of the photoreceptive drum 1 is not always effectively, electrically charged and, therefore, is not satisfactorily removed from the surface of the photoreceptive drum 1 even with the help of the electromagnetic bristle of developer, these stuck mosses of developer will undesirably appear on the resultant copied paper, resulting in producing relatively large black specks. Furthermore, since the region of the photoreceptive drum 1, which is denoted by (A) in FIG. 3, is exposed to the dust from the unused powder, the dust stuck on the photoreceptive drum 1 will also caused the same defect as that described above, producing a number of small specks on the resultant copied paper, owing to the fact that the dust stuck on the photoreceptor surface within the region described above has not been effectively electrically charged and, thereby can not be effectively removed from the surface of the photoreceptive drum 1 so as to constitute a portion of the substantial developing material accordingly. Moreover, in spite of the special arrangement of the roll 105 according to the developing apparatus shown in FIG. 1, since minute, gradual escape of the dust from the unused powder floating in the space denoted by (B) in FIG. 3 from the developing apparatus into the surrounding subsystems constituting the electrophotographic copying machine can not be completely prevented, resultant contamination of such subsystem is unavoidable.

Lastly, in order to completely eliminate the contamination of the copied image, there should be further considered an appropriate control of the developing apparatus in connection with respective functionings of the subsystems constituting the electrophotographic copying machine, so that occurrences of such defects as previously pointed out are substantially prevented. Conventionally, in a developing apparatus of a power image transferring type which is arranged to employ a two component developer, the developing apparatus is conventionally so arranged that either the developing sleeve 6 or the multipolar magnet member 7 is rotated and the developing apparatus itself is arranged to be impressed with a biasing electrical potential having a level at least corresponding to that of the background portion of the latent image on the photoreceptor surface. With respect to the impression of the biasing electrical potential, the actuation to effect the ON-mode of operation is conventionally accomplished either at the instant or a little prior to the arrival of the leading portion of the latent image at the developing station, while the actuation to effect the OFF-mode is conventionally accomplished either at the instant when the trailing portion of the latent image passes through the developing station or a little later on, so that the resultant, copied paper will not be fogged. Furthermore, in order to form the exact latent image on the photoreceptor surface, the relatively longer peripheral surface-portion of the photoreceptor surface other than the portion really necessary for the image light-exposure is arranged to be electrically charged in advance by the corona discharger. Therefore, as a result, there are respective, leading and trailing unnecessarily charged peripheral surface-portions on the photoreceptor surface, with the substantial portion on which the latent image is to be formed being interposed therebetween. Such being the case, if the developing sleeve 6 and/or the multipolar magnet 7 is kept rotating even after the completion of developing process of the substantial portion to be developed, the trailing portion is undesirably developed, whereby not only is there an unnecessary consumption of developer, but also excessive overloads on the respective developer-cleaning members cannot be avoided. Consequently, to prevent the undesirable situations described above, either the rotation of the developing sleeve or the rotation of the multipolar magnet member is arranged to be stopped immediately after the end portion of the latent image is passed through the developing station.

In the course of one step of developing the present invention, the conventional developing control described above was applied as the control for the developing apparatus of the magnetic brush development type using the above-mentioned developer constituted by the non-magnetizable particles and magnetizable particles, with only the multipolar magnet member 7 being rotated. As a result, not only did the respective copied images begin to have extremely degraded qualities in accordance with the increase the number of continuous copying runs, but also there were brought about conditions in which the trailing, unnecessarily charged portions following the substantial latent image portion were developed. This is mainly due to the fact that, since the developers constituted by non-magnetizable particles and magnetizable particles, which have recently been improved as previously described, are provided with relatively higher coherent and adherent natures in comparison with the conventional two component developers, and they are easily coagulated and then solidified on the peripheral surface of the developing sleeve 7 when affected by the environmental damp conditions and/or respective mutual, electrostatic inducing forces arising among the respective particles, and thereby, they are prevented from being effectively transported on the peripheral surface. Consequently, in a developing apparatus wherein the developer constituted by the non-magnetizable particles and magnetizable particles is employed, such simple arrangements for rotating either the developing sleeve or the multipolar magnet member as described above can not effectively bring about the appropriate developing process and, some substantial precautions to prevent the solidification of the developer should be taken for a proper developing process. In addition to the precautions described above, since the non-charged portion on the photoreceptive surface unavoidably has magnetizable particles charged with the same polarity as that of the biasing electric potential adhered thereto due to the biasing electrical potential which is being impressed on the developing sleeve by the biasing voltage source, it is necessary to substantially improve control of the subsystems constituting the developing apparatus, with improvements concerning the actuational mode of the impression of biasing electric potential by the biasing electrical potential source also being included.

SUMMARY OF THE INVENTION

Accordingly, an essential object of the present invention is to provide a magnetic brush development apparatus, which has a specifically novel construction and is highly efficient in use.

Another important object of the present invention is to provide a magnetic brush development apparatus of the above-described type, which is specifically arranged to use a developer constituted by non-magnetizable particles and magnetizable particles.

A further object of the present invention is to provide a magnetic brush development apparatus of the above-described type, which is arranged to be specifically adaptable for an electrophotographic copying machine.

A still further object of the present invention is to provide a magnetic brush development apparatus of the above-described type, which is arranged to overcome all the disadvantages of the previously developed device specifically described in the foregoing.

In accomplishing these and other objects according to one preferred embodiment of the present invention, there is provided a magnetic brush development apparatus which will be specifically described hereinbelow. In a dry process developing apparatus for use in an electrophotographic copying machine which includes a developing casing; a developing sleeve rotatably provided in the developing casing; a multipolar magnet member also rotatably accommodated in the developing sleeve for developing an electrostatic latent image formed on an image bearing member into a visible image by bringing the electrostatic latent image described above into contact with developing material transported on the developing sleeve; means for driving the multipolar magnet member for rotation in the same direction as the rotation of the developing sleeve within the developing sleeve; and a scraper member provided for sliding contact with the surface of the developing sleeve, the apparatus according to the present invention is further characterized by the following:

(i) To remove developer retained on the peripheral surface of the developing sleeve, which would be otherwise transported in the reverse direction with respect to direction of transportation of the developer, not only is there provided at least one cleaner member a substantial portion of which is urged into contact with the peripheral surface of the developing sleeve while directed in the opposite direction to the direction of rotation of the developing sleeve, but also the scraper-member is arranged to be relatively spaced from the peripheral surface of the developing sleeve in a manner such that developer stuck to the peripheral surface can only be passed through a clearance between the peripheral surface and the scraper-member, only when the developer is rotatably transported in the reverse direction, whereby the undesirable phenomena, in which the developer which has not been scraped off by the cleaner-member is gradually, forcibly deposited between the surface of the developing sleeve and the scraper-member and, thereby, there is brought about a deposit of coagulative developer, is avoided.

(ii) There is provided a trapping member for dust from unused powder which has escaped, especially from an opening in the developing apparatus, which is disposed in the neighborhood of the opening and is interposed between the developing sleeve and the outer casing of developing apparatus and faces the scraper-member, whereby undesirable, free dispersion of the developer and its resultant escape especially from the opening is prevented.

(iii) Besides that the inner surface of a portion of the casing, which partially encloses a substantially upper portion of developing sleeve, is formed in a circular shape so that a substantial magnetic brush is generated on and around the peripheral surface of the developing sleeve which is appropriately in close contact with the inner surface, and there is further provided an electrically insulating sealing member, which is disposed so as to overlap a leading edge-portion of the portion of the casing, while a leading edge of the sealing member is arranged to be in contact with the photoreceptive surface, whereby since respective adhesion of the cloud of dust from the unused powder to the inner surface of the casing and undesirable exposure of the photoreceptor surface to the dispersed dust are both avoided, the occurrences of defects such as fogging or dark specks on the copy paper bearing a copied image, can be effectively prevented.

(iv) A developer comprising non-magnetizable particles and magnetizable particles having approximately the same particle-diameter with respect to each other, is retained on the peripheral surface of the developing sleeve, and the rotational speed of the multipolar magnet member rotatably enclosed in the developing sleeve mentioned above is much higher than that of the developing sleeve so that the developer is transported to the developing station, with the developer being transported being in the form of the magnetic brush thereby to develop the electrostatic latent image at the developing station, while a biasing electrical potential substantially equivalent to that given by the background portion of the latent image on the photoreceptor surface is simultaneously impressed on the developing sleeve. Furthermore, the apparatus is further characterized in that not only is the multipolar magnet prevented from rotating after the end portion of the electrostatic latent image has passed through the developing station, but also the impression of the bias electrical potential described above is interrupted after the unnecessarily charged portion trailing the electrostatic latent image on the photoreceptor surface has fully passed through the developing station. By a sequential control as described above, in addition to obtaining excellent developing results, because the developer is arranged to be applied only to the substantial portion of the electrostatic latent image formed on the photoreceptive surface, not only in a minimum amount of the developer consumed, but also excessive overloads, which are otherwise imposed on the cleaning members, are prevented. With respect to the defect of overloads of the respective cleaning-members, it is to be noted here that the concept of the overloads mentioned above further causes degradation in the functioning of the respective cleaning-members, which is caused by the fact that a rather large amount of magnetizable particles adhere to the non-electrically charged portion and are successively transported to the respective cleaning-members when the biasing electrical potential remains impressed even while the non-electrically charged portion is passed through the developing station.

BRIEF DESCRIPTION OF THE DRAWINGS

These and other object and features of the present invention will become apparent from the following description taken in conjunction with the accompanying drawings in which:

FIG. 12(*b*) is a fragmentary top plan view showing attachment of the plate-like member of FIG. 12(*a*)

Before the description of the present invention proceeds, it is to be noted that like parts are designated by like reference numerals throughout several views of the accompanying drawings.

DETAILED DESCRIPTION OF THE INVENTION

Figure 4:
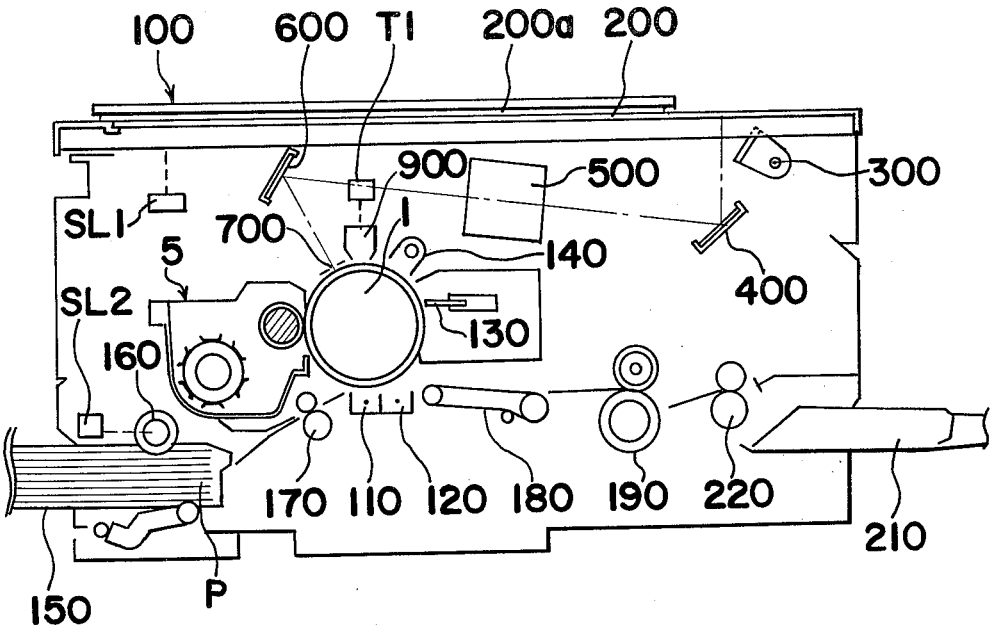
FIG. 4 is a schematic side view of an electrophotographic copying apparatus in conjunction with which the present invention is used.

Referring now to FIG. 4, there is shown a schematic side view of an electrophotographic copying machine in which the present invention is used. The operation of this electrophotographic copying machine can be summarized as follows.

An original (not shown here) to be copied is first set onto a transparent plate, for example, a glass plate 200 provided for a manuscript tray 100, which is capable of being substantially horizontally reciprocally moved. Upon the completion of an actuation of a scanning solenoid SL1, the manuscript tray 100 starts a substantially horizontal, right transit in FIG. 4, whereby the light image of the original image on the original is successively exposed onto a photoreceptive drum 1, which is here being rotated counterclockwise, by an optical scanning system including an exposure lamp 300, a first mirror 400, a projection lens 500, a second mirror 600, and a slit-member 700. As can be seen in FIG. 4, in this electrophotographic copying apparatus there are further provided a corona-charger 900, the slit-member 700 for exposure, a magnetic brush development apparatus 5 to be specifically described hereinbelow, a transferring charger 110 for electrostatically transferring a developed image onto a copy paper (P), a separating charger 120 for removing the copy paper (P) from the photoreceptor surface, a cleaning blade 130 for forcibly removing residual developing particles from a photoreceptor surface, and an erasing lamp 140 for electrostatically erasing residual electrical charge still present on the photoreceptor surface, which are all spaced around the periphery of the photoreceptor drum 1 in succession in the rotational direction of the photoreceptive drum 1. More specifically, the corona-charger 900 is electrically connected to a transformer T1 and, is controlled so as to charge a relatively longer peripheral surface of the photoreceptive surface than the peripheral surface required for forming the electrostatic latent image. The necessity for the control described above is first due to the fact that it takes a certain period for the corona-charger 900 to reach its steady operating condition after it is electrically actuated to the ON-mode. The second reason for the necessity for the control described above is that the photoreceptive surface is electrically charged in a manner as described above to avoid occurrence of a non-uniformly charged peripheral surface portion in the peripheral surface portion required for forming the electrostatic latent image, especially in the trailing peripheral surface portion thereof, which undesirable condition is naturally effected if the corona-charger is electrically actuated to the OFF-mode immediately after a portion, corresponding to the end portion of the electrostatic latent image to be formed, has passed the position of the corona-charging station.

Figure 5:
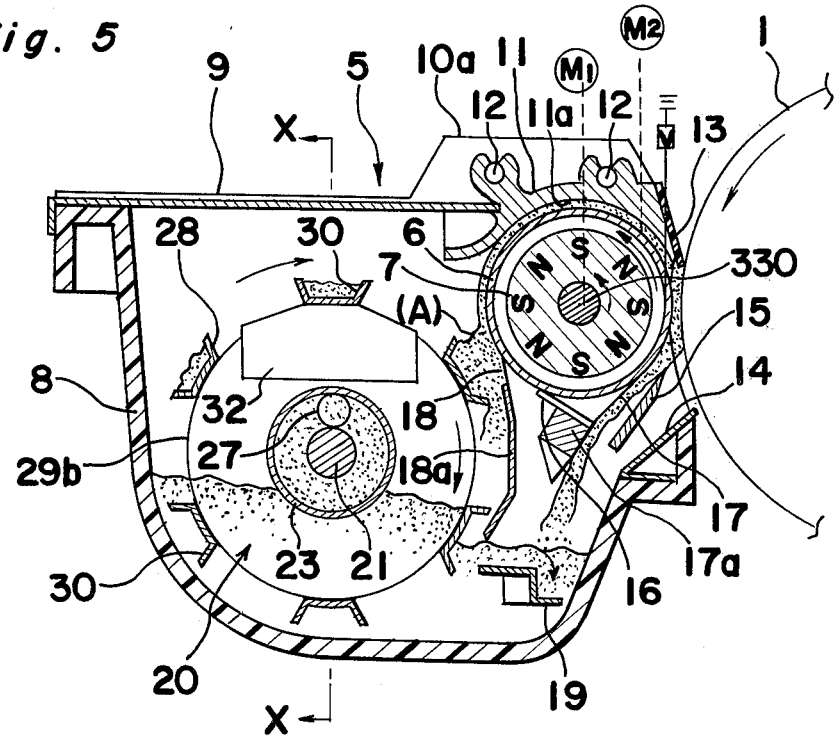
FIG. 5 is a schematic side sectional view of a magnetic brush development apparatus according to one preferred embodiment of the present invention.

The sheets of copy paper (P) are stacked within respective, specific cassettes 150, each of which is provided on the electrophotographic copying machine and provided with a size of paper corresponding to the size of the original to be copied. Hence, sheets of copy paper each having an appropriate paper-size are successively fed toward the transferring station 110 one by one by means of a paper feeding roller 160 electrically actuated by a paper feeding solenoid SL2. The paper (P) fed inside the copying machine is transported to the electrostatic transferring station by a paper transporting roller 170 and then, is successively transported to a fixing station with the help of a transporting belt 180, thereby to be fixed by means of a pair of heat rollers 190. The copy paper bearing the image transferred thereto is then discharged from the copying machine onto a tray 210 with the help of a discharging roller 220. Referring now to FIG. 5, the magnetic brush development apparatus 5 according to the present invention comprises a developing sleeve 6, a multipolar magnet member 7 rotatably enclosed in the developing sleeve 6, and a developing material stirring device 20 also rotatably accommodated in a casing constituting a developing material storage tank 8, wherein a powder developer constituted by non-magnetizable particles and magnetizable particles appropriate for use in the apparatus is provided. More specifically, the developer is a mixture composed of magnetizable particles in an amount ranging from 85 wt% of the total weight of the developer to 98 wt% and insulating non-magnetizable particles in an amount ranging from 2 wt% to 15 wt%, wherein the magnetizable particles have an average particle diameter ranging from 10 to 50 $\mu$m and an electroresistivity ranging $10^{10}$ to $10^{14}\Omega\cdot$cm, while the non-magnetizable particles have an average particle diameter ranging from 5 to 25 $\mu$m. Each magnetizable particle is to be triboelectrically charged with the same polarity as that given the electrostatic latent image, whereas each non-magnetizable particle is to be triboelectrically charged with the reverse polarity.

For making the magnetizable particles having a high electro-resistivity, 100 parts by weight of HYMER-SBM-73 (trade none for Styrene acrylic resin manufactured by Sanyo Chemical Industries, Ltd., Japan) and 200 parts by weight of Iron oxide RB-BL (trade name for oxide manufactured by Chitan Kogyo Co., Ltd., Japan) having an electro-resistivity of $3\times10^5\ \Omega\cdot$cm and an average particle diameter of 0.6 $\mu$m, are first mixed and the resultant mixture is crushed by a conventional crushing method, thereby to provide particles. The particles thus produced are further mixed with 8 parts by weight of carbon black and are heat-treated at a temperature of 130° C., so that carbon black will be fused onto respective particles. Each magnetizable particle thus produced has an electro-resistivity of $2\times10^{12}$ $\Omega\cdot$cm and an approximate average particle diameter of 25 $\mu$m. For preparing the non-magnetizable particles, 100 parts by weight of PRIOLITE-ACL (trade name for Styrene acrylic resin manufactured by Goodyear Rubber Chemical Co., Ltd.), 8 parts by weight of carbon black, and one part by weight of NIGRISIN (trade name for dye manufactured by Orient Chemical Co., Ltd., Japan) are mixed and then fused with respect to each other. After having been mechanically crushed, the resultant particles are successively air-classified, so that the particles each having an average particle diameter of 10 $\mu$m are obtained. An alternative process for the preparation of magnetizable particles having a high electro-resistivity comprises the successive steps of mixing 100 parts by weight of HYMER-SBM-73, 200 parts by weight of minute, magnetic particles and 4 parts by weight of carbon black, fusing the mixture composed in the step as described above, mechanically crushing the fused mixture, and air-classifying the resulting particles. Each magnetizable particle thus produced has an average particle diameter of 20 $\mu$m and an electro-resistivity of $2\times10^{13}\ \Omega\cdot$cm, respectively.

Still referring to FIG. 5, as described earlier, the magnetic brush development apparatus substantially comprises the developing sleeve 6 and the multipolar magnet member 7 rotatably enclosed in the developing sleeve 6. Here, the developing sleeve 6 having a cylindrical configuration made of non-magnetizable electrically conductive material such as aluminum is mounted for rotation counterclockwise at 30.2 r.p.m. in a position close to the surface 1*a* of the photoreceptor drum 1 which is also capable of rotating counterclockwise. The multipolar magnet member 7 having a roll-like configuration has magnetic poles N and S sequentially alternately arranged around its outer periphery as shown and is adapted to rotate at a speed of 1300 r.p.m. in the same direction as the developing sleeve 6. More specifically, the developer is given one certain specific moving speed in the clockwise direction by rotation of the multipolar magnet member 7, and also a second certain specific moving speed in the counterclockwise direction by rotation of the developing sleeve 6, and consequently is moved along the surface of the developing sleeve 6 at a speed equal to the difference of the above-described two rotational speeds in the clockwise direction.

Figure 10:
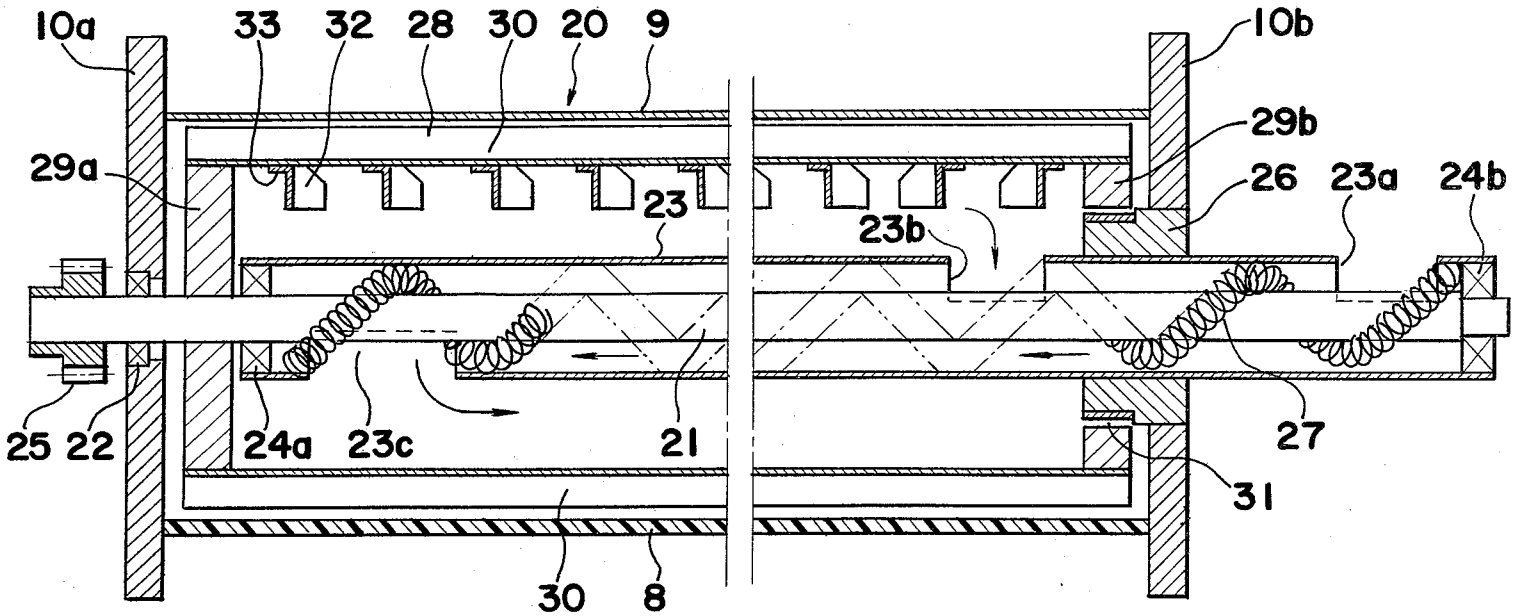
FIG. 10 is a sectional view taken along the line X—X of FIG. 5.

The magnetic brush development apparatus according to the present invention is enclosed by the casing 8, an upper casing 9, and a pair of side walls 10*a* and 10*b*, which are specifically shown in FIG. 10. In a position above developing sleeve 6, there is provided a casing member 11, which is connected to the upper casing 9 with a plurality of bolts 12 so as to constitute a portion of the upper casing 9, and which has an inner surface 11*a* having a circular form so that magnetic brush produced on the developing sleeve 6 will be effectively in close contact therewith. In addition to the casing member 11 described above, there is further provided an electrically insulating sealing member 13, which is disposed so as to overlap the leading edge-portion of the casing member 11, with the leading edge of the sealing member 13 being in contact with the photoreceptor surface. In a position below developing sleeve 6, there are provided a lower enclosing member 14, a developer-trapping member 15, a supplementary cleaning member 16 the free end portion of which is directed in a direction opposite the direction of rotation of the developing sleeve 6, a scraping member 17 the free end portion of which is directed in the same direction as the direction of rotation of the developing sleeve 6, a cleaning member 18 having a portion directed in a direction opposite the direction of rotation of the developing sleeve 6, and a blade member 19 capable of rotating clockwise. By this arrangement the developer is transported clockwise by a plurality of trough-like members 30 on a bucket roller 28, until the developer reaches the position (A) whereat the developer is affected by the magnetic force of the multipolar magnet member 7. At the point (A) the trough-like member 30 is turned over thereby to pour the developer toward the developing sleeve 6, whereby the developer is successively moved clockwise, with the developer taking the form of magnetic brush on the developing sleeve 6. In accordance with the clockwise rotation of the developer, in the form of magnetic brush, the developer makes rubbing contact with the electrostatic latent image already formed on the photoreceptor surface in a known manner so that the electrostatic latent image on the photoreceptor surface is developed. After having accomplished this developing step, the developer is scraped off the circumferential surface of the developing sleeve 6 by the scraping member 17, and is successively moved toward the bucket roller 28 by the blade member 19. The developer on the developing sleeve 6 is further removed from the peripheral surface of the developing sleeve 6 by the respective members 18 and 16 in the course of a single rotation of the developing sleeve 6.

In connection with the transportation of the developer toward the developing station as well as the removal of the developer from the developing sleeve 6, the respective members disposed around the photoreceptive drum 1 in the manner as described in the foregoing are specifically arranged and, are characterized as follows, respectively, although a concise explanation of the respective members has been already given in the foregoing.

Figure 3:
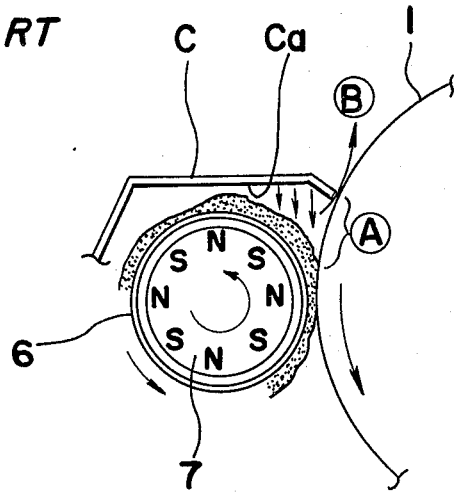
Fig. 3 PRIOR ART
FIG. 3 is a view similar to FIG. 2, but particularly schematically showing the escape of a cloud of dust from unused powder developer.
Figure 6:
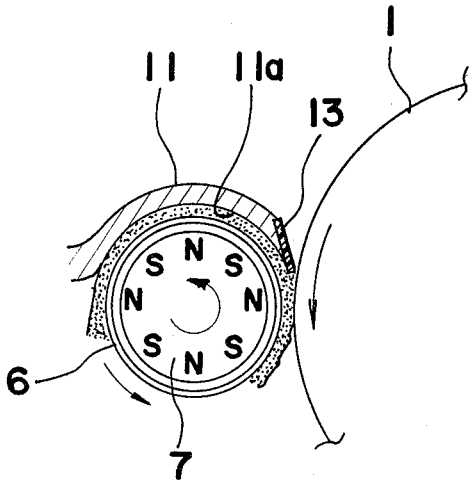
FIG. 6 is a view similar to FIG. 3, but particularly shows one preferred embodiment of a member for preventing the escape of a cloud of dust from unused powder of the developer according to the present invention.

With respect to the configuration of the inner surface 11*a* of the member 11, the inner surface 11*a*, which has the circular shape as described above, is capable of allowing the magnetic brush on the developing sleeve 6 to be in close contact with the inner surface, so that the magnetic brush will steadily rub the inner surface. More specifically, since a triboelectrical charge to be formed between the non-magnetizable particles and the magnetizable particles is, in general, much higher than that formed between the casing member 11 and the magnetic brush, the kind of material employed for the casing member 11 is not critical and, either resins or metals can be used. The clearance between the outer circumference of the developing sleeve 6 and the inner surface 11*a* of the casing member 11 is chosen according to predetermined developing conditions as well as characteristic nature of the developer to be employed for the developing process etc. Furthermore, with respect to the electrically insulating sealing member 13, as specifically shown in FIG. 6 and described in the foregoing, the member 13 is disposed so as to overlap the leading edge-portion of the casing member 11. The material employed for the member 13 should be elastic and electrically insulating, so that not only will the electrostatic latent image formed in advance on the photoreceptor surface 1*a* not be electrostatically disturbed but also the photoreceptor surface 1*a* itself will not be made less effective by being forcibly scraped. urethane rubber or MYLAR (trade name of rubber-like material manufactured by Du Pont Co., Ltd.) is good for the material of the member 13. By the configuration of the inner surface 11*a* of the member 11 together with the provision of the member 13, since the adhesion of the cloud of dust from unused powder to the inner surface Ca of the upper casing and the undesirable exposure of the portion (A) of the photoreceptor surface to the dispersed dust from the unused powder, both specifically shown in FIG. 3, are effectively prevented, occurrences of defects such as fogging or dark specks on the copy paper bearing the copied image can be effectively avoided. In addition, escape of the dispersed non-used powder from the inside of the developing apparatus, which is specifically illustrated by the arrow (B) is substantially prevented by the existence of the member 13 according to the present invention. The developing sleeve 6 is driven so long as a copy start switch or a main switch (not shown) is kept in the ON-mode, whereas the multipolar magnet member 7 is prevented from rotating during the non-developing period, so that the developer will not adhere to the photoreceptor surface during such period. Furthermore, the biasing electrical potential to keep the same polarity as that of the electrostatic latent image is impressed on the developing sleeve. As far as the operation of the developing sleeve 6 is concerned, the rotation of the developing sleeve 6 is arranged to start immediately after the ON-actuation of the copy start switch, and the developing sleeve 6 is arranged to stop when a predetermined period, for example about 15 seconds, has elapsed from the instant of completion of the copying run.

Figure 7:
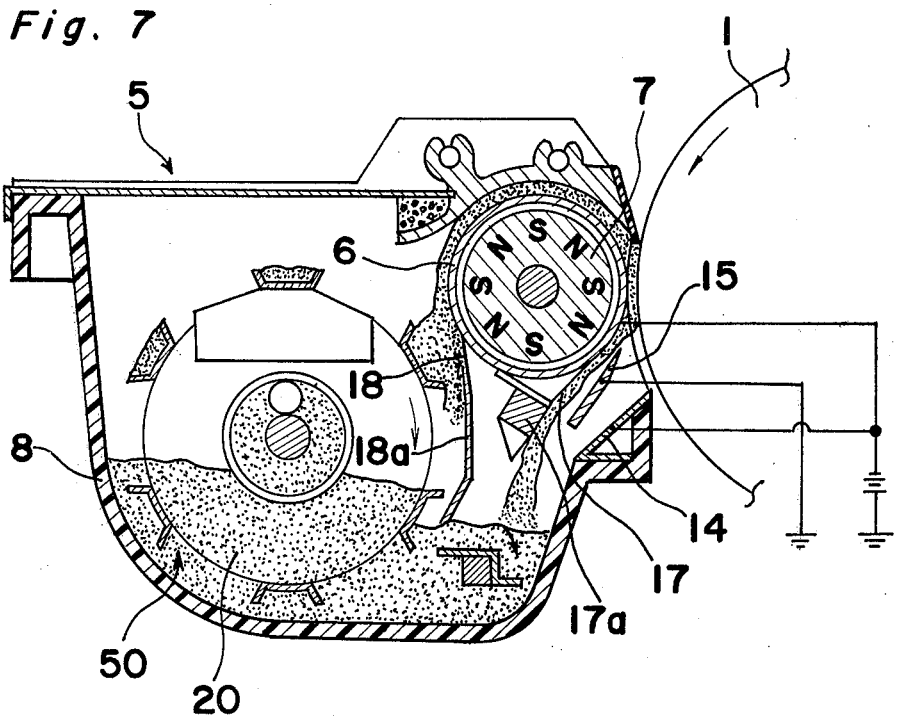
FIG. 7 is a view similar to FIG. 5, but particularly shows circuit arrangements to be employed for impressing the bias electric potential on the apparatus according to the present invention.
Figure 8:
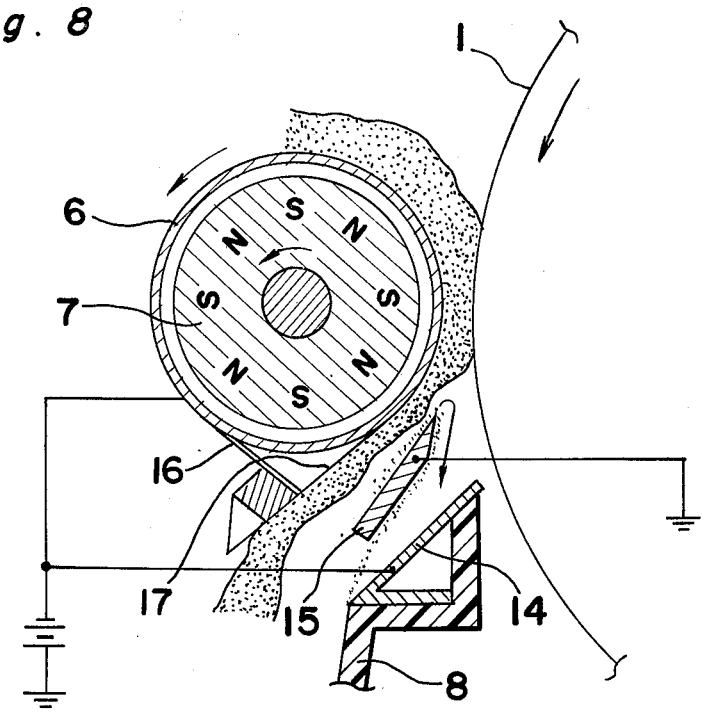
FIG. 8 is a schematic side elevational view showing on an enlarged scale, construction of a developing section employed in the arrangement of FIG. 7 and for explaining the behavior of the developer.

With respect to the lower enclosing member 14 together with the developer-trapping member 15, there should be provided the following specific improvements to prevent respective particles constituting the developer from escaping from the inside of the developing apparatus, since a portion of the magnetizable particles is affected by the magnetic force of the multipolar magnet member 7, and a portion of non-magnetizable particles is affected by gravitational force in the vicinity of these members. As will be specifically described hereinbelow, to prevent the magnetizable particles from escaping from the inside of the developing apparatus, the lower enclosing member 14 is preferably made of a suitable metallic material and further has a bias electric potential impressed thereon. By this means the undesirable transportation of magnetizable particles due to the existence of the electric field of the developing sleeve 6 and photoreceptive drum 1 is effectively avoided. Referring now to FIGS. 7 and 8, there is shown one preferred embodiment of the lower enclosing member 14 together with the developer-trapping member 15 according to the present invention. The lower enclosing member 14 is disposed at a lower position than that of the developer-trapping member 15 and is made of an electrically-conductive material such as aluminum or brass. As specifically shown in FIG. 8, the developing sleeve 6 as well as the lower enclosing member 14 respectively have impressed thereon a bias electrical potential so as to respectively have the same electrically negative polarities. The electrostatic latent image on the photoreceptor surface is also given on electrical potential of negative polarity. In addition, in order to effectively avoid the escape of the non-magnetizable particles from the inside of the developing apparatus 5, the leading portion of the lower enclosing member 14 is spaced from the peripheral surface of the photoreceptive drum by approximately 1 mm and the member 14 is arranged to have the ends overhang the sides of the peripheral surfaces of the drum at the axial end portions of the photoreceptive drum 1 by approximately 1 mm. Furthermore, the member 14 is positioned at an angle with reference to a reference level which is more than the angle of repose of the non-magnetizable particles employed, so that the developer will slide down the member 14 and fall into the inside of the developing apparatus 5. In the present embodiment, the angle of the member 14 is 45 degrees. The developer-trapping member 15, which is disposed between the developing sleeve 6 and the lower enclosing member 14, is made of electrically-conductive material such as aluminum and can be in any one of several electrical conditions i.e., (1) on electrically floating condition; (2) electrically grounded condition; (3) biased by an electrical potential having a polarity opposite the polarity of the biasing electrical potential which is being impressed on the developing sleeve 6. By the provision of the respective members 14 and 15, soon after the developing step is completed, the developer retained on the peripheral surface of the developing sleeve 6 is first scraped off the sleeve 6 by the developer-scraping member 17 and gravitationally falls into the developing material storing portion 50, whereas the dispersed developer collides with the scraping member 17 and is mostly blocked by the member 15, whereby occurrence of dispersion or escape of the developer from the developing apparatus is effectively prevented at the same time. Furthermore, a certain amount of the unused developer powder, which is being dispersed inside the apparatus, is electrostatically caught by the developer-trapping member 15. This is due to the fact that the magnetizable particles having a negative polarity are electrostatically attracted by the developer-trapping member 15. More specifically, according to the biasing electrical circuit arrangements as described above, the developer-trapping member 15 has an electrical potential of approximately a zero level when the developing sleeve 6 and the lower enclosing member 14 are both impressed with a biasing electrical potential having a negative polarity, with the developer-trapping member 15 being either in the floating condition or in the grounded condition. Alternatively, in the case wherein there is no necessity of electrically attracting the developer to the developer-trapping member 15, the developer-trapping member 15 can be made of electrically insulating material. However, owing to the provision of the developer-trapping member 15, the cloud of developer powder, which is dispersed from the developing sleeve 6, will neither be attracted to the lower enclosing member 14, nor be dispersed around the photoreceptor surface 1*a*, and there may not be brought about the adhesion of the developer to the photoreceptor surface. Consequently, by the provision of the developer-trapping member and the lower enclosing member, which are both disposed in the neighborhood of the opening of the casing of the developing apparatus and spaced and interposed between the developing sleeve 6 and the photoreceptor 1 as described above, the undesirable free dispersion of the developer and its resultant escape from the opening is well prevented. More specifically, particles of the developer thus electrostatically adhering to the upper surface of the developer-trapping member 15 roll up along this surface as specifically shown by the arrow in FIG. 8, subject to influences of the magnetic force of the multipolar magnet member 7 rotatably enclosed by the developing sleeve 6, until they reach the upper edge portion of the member 15 and then roll down along a rear surface of the member 15 and fall down to the developing material storing portion 50. This is due to the fact the rear surface of the member is affected by a much weaker magnetic force as compared with that prevailed on the upper surface. Furthermore, according to the present embodiment, the disposition of the member 15 is such that the clearance between the developing sleeve 6 and the member 15 is sufficient for preventing the developer being transported along the peripheral surface of the developing sleeve 6 from being interfered with by the developer trapping member 15. In connection with the functional characteristics of the scraping member 17, the developer-trapping member 15 faces the leading portion of the member 17 in a manner such that the developer removed from the circumference of the sleeve 6 by the scraping member 17 is well blocked by the developer-trapping member 15. More specifically, the portion of developer dispersed when the developer retained on the peripheral surface of the developing sleeve 6 collides with the leading portion of the scraping member 17 is blocked by the member 15, whereby the generation of dust from the unused powder is presented by the provision of the member 15. As shown in FIG. 5, substantially all of the developer used is first scraped off the peripheral surface of the developing sleeve 6 by the leading portion of the member 17 and directed downwards along the rest of the member 17. Therefore, the bulk of the developer used falls gravitationally at a position in which the bulk of the developer separates from the member 17. Accordingly, the member 15 is disposed out of the path of the gravitational fall of the developer, so that the bulk of the falling developer is not interfered with by the member 15. Furthermore, although there is hardly any collision of the developer with the developer-trapping member 15 in the arrangement described above, the leading portion of the member 15 is further given a knife edge-like shape as specifically shown in FIG. 8 so as to lessen the absolute amount of the cloud of dust from unused developer caused by such a collision.

As far as the cleaning member 18 and the supplementary cleaning member 16 are concerned, these are provided to clean the developer retained on the peripheral surface of the developing sleeve 6 and are directed in the same direction as the normal direction of transportation of the developer, which is transported in the clockwise direction during the counterclockwise rotation of the developing sleeve. More specifically, each of the cleaning members 16 and 18 is urged into contact with the peripheral surface of the developing sleeve 6 and is directed opposite to the direction of rotation of the developing sleeve 6. Furthermore, one of the important characteristics of the cleaning member 18 is that the member 18 serves for controlling the amount of the developer to be transported at the position whereat the developer is magnetically retained by the peripheral surface of the rotating developing sleeve 6. More specifically, of the developer which has been transported toward the position (a) by the plurality of trough-like members 30, the amount entrained toward the developing station by the rotation of the developing sleeve 6 is limited to a predetermined amount by the member 18. As described earlier, according to the present embodiment, the developing sleeve 6 is constantly driven, whereas the multipolar magnet member 7 is not rotated during the non-developing period. Thus in the non-developing period, the developer retained on the peripheral surface of developing sleeve 6 is transported counterclockwise. Accordingly, during the non-developing period, the cleaning member 18 removes the developer retained on the peripheral surface of sleeve 6, whereby undesirable contact of the developer with the photoreceptor surface is effectively avoided.

As far as the scraping member 17 is concerned, the member 17 is capable of removing the developer from the peripheral surface of developing sleeve 6 and, is further resiliently movable away from the peripheral surface of the developing sleeve 6 in a manner such that the developer adhering to the peripheral surface will pass between the peripheral surface and the scraping member 17, at least when the developing sleeve 6 is rotated counterclockwise and the multipolar magnetic member 7 is stationary. To effect the situation described above, a substantial scraping portion of the scraping member 17 is urged into contact with the peripheral surface of the developing sleeve 6 and directed in the direction of the rotation of the developing sleeve 6 as will be specifically described hereinafter. By this arrangement, the undesirable conditions in which the developer which has not been scraped off by the respective cleaning members 16 and 18 is gradually, forcibly deposited between the surface of the developing sleeve 6 and the scraping member 17 and thereby, there is brought about an deposit of coagulative developer, is effectively avoided. Although the developer which has not been scraped off the scraping member 17 during the developing period may sometimes be deposited in the space between the contacting portion of the supplementary cleaning member 16 and the sleeve 6, during the non-developing, the deposited particles of developer are first passed through the clearance described above and are afterward removed by means of the cleaning member 18. It is to be noted here that the occurrence of deposition of developer between the supplementary cleaning member 16 and sleeve 6 is limited to the case wherein the multipolar magnet member 7 is kept rotating, i.e., in the developing period, whereas the developer is soon, in turn, cleaned off the sleeve during the course of the succeeding nondeveloping period. Accordingly, the amount of the developer accumulated on the peripheral surface of the developing sleeve 6 is kept very low. Therefore, since the mechanical force exerted on the developer is also very small, the developer on the peripheral surface of the sleeve will not be coagulated.

In the following, there are given further detailed descriptions of the scraper member 17, the cleaning member 18, and the supplementary cleaning member 16 according to the present invention.

Figure 9:
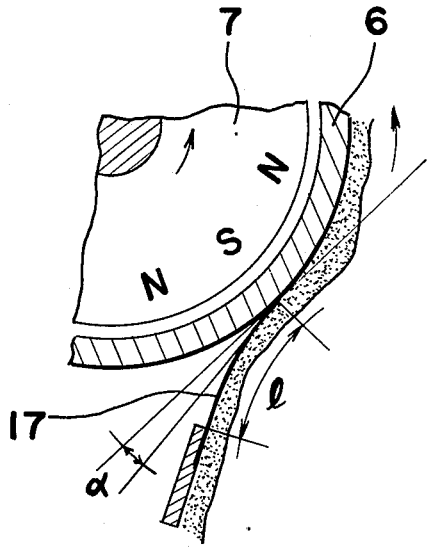
FIG. 9 is a schematic side elevational view showing on an enlarged scale, construction of a developing section employed in the arrangement of FIG. 5 for explaining the principle of removal of the developer with a scraping member according to the present invention.

Still referring to FIGS. 7, 8 and 9, to achieve functional characteristics as previously described, the leading portion of scraping member 17 is urged into contact with the peripheral surface of the developing sleeve 6 while being directed in the direction of rotation of the developing sleeve 6. The urging contact of the leading portion with the peripheral surface permits the developer to be scraped off the peripheral surface of the developing sleeve 6 during the forwarding movement of the developer during the developing period. Therefore, the making of the scraping member 17 movable away from the developing sleeve 6 can be achieved with the help of the support shaft 17*a*. In addition, the construction of the scraping member 17 and the material are such that the scraping member 17 is capable of being moved away from the surface of the sleeve 6 by the developer remaining on the peripheral surface during the counterclockwise rotation of the developing sleeve 6, so that the developer remaining on the peripheral surface of the developing sleeve 6 is not prevented from passing below the member 17. In order to permit the developer on the peripheral surface to be passed as described above, a substantial portion of the member 17 itself must have substantially flexible characteristics and should be arranged to be movable away from the peripheral surface of the developing sleeve 6 and is further made of an appropriate material so that the developer moving clockwise around the peripheral surface of sleeve 6 in the developing period is effectively removed. Furthermore, the leading portion of the member 17 should be thin because otherwise it would prevent a smooth removal of developer and moreover would form a space in which developer is unnecessarily deposited at a lower boundary of the developing sleeve 6 and the photoreceptive drum 1. The existence of the space often brings about fogging of the copied images. According to one preferred embodiment of the present invention, which takes into consideration of all the requirements described above, the scraping member 17 is made of MYLAR, which has a thickness of 50 μm, and, is spaceable in respect to the peripheral surface of the developing sleeve 6. More specifically, the leading portion (l) of the member 17 is urged into contact with the peripheral surface at an angle (α) of 7 degrees and projects forward from the support shaft 17*a* a distance l of 10 mm, as specifically shown in FIG. 9. The inventors of the present invention have determined appropriate conditions for the member 17, according to which the preferred thickness of the flexible portion lies in a range of 30 to 100 μm, the angle as denoted by (α) is in a range of 0 to 30 degrees, and the projecting portion denoted by (l) being in a range of 5 to 20 mm.

With respect to the respective cleaning member 18 and supplementary cleaning member 16, they are provided so as to remove the developer retained on the peripheral surface of the developing sleeve 6, which would be otherwise transported during the rotation of the developing sleeve 6. Therefore, respective portions of the developer which respectively exist around respective leading portions of the cleaning and supplementary cleaning members, respectively have exerted thereon relatively large mechanical forces, whereby each portion of the developer at each leading portion is apt to be solidified by heat and pressure produced by the exertion of such forces. Such being the case, if the respective leading portions of the members 16 and 18 are made thick, particles of developer which have large diameters are apt to be thus affected at the respective leading portions and thereafter transported to the developing station and further transferred to the surface of the photoreceptor drum 1, whereby undesired copied images are often produced. A typical defect caused by the coagulation of the developer in the previously described manner, is the production of several black specks including dimmings therein which are produced around the copied images on the copy paper when the developed images on the surface of the photoreceptive drum 1 are electrostatically transferred to the copy paper. In addition to the requirement described above, that the leading portion of the members 16 and 18 be thin, respective configurations and materials used for the members 16 and 18 should be such that both members are capable of performing their respective, functions, which are the respective removals of the developer remaining on the peripheral surface of the developing sleeve 6 during the counterclockwise rotation of the developing sleeve 6. In order to effectively accomplish the functions described above, according to one preferred embodiment of the present invention, the respective cleaning and supplementary cleaning members 16 and 18 are both made of MYLAR having a thickness of 200 μm and have the base ends mounted in spaced relation to the peripheral surface of the developing sleeve 6, respectively. More specifically, the leading portion of respective members 16 and 18, corresponding to the portion of the scraping member 17 the length of which is denoted by (l) in FIG. 9, is urged into contact with the peripheral surface of the developing sleeve 6, at an angle (i.e., (α) in FIG. 9) of 15 degrees and the length l is 5 mm. According to an experiment carried out by the present inventors, preferred conditions for the respective members 16 and 18 have been found to be as follows. The thickness of both members should be in the range from 100 to 500 μm, respectively. More specifically, each of the members should be made of an elastic or resilient materialsheet having a thickness ranging from 100 to 500 μm preferably 150~250 μm, or be made an elastic material-sheet, and the leading portion should be formed in a knife edge-like shape having a leading edge of 500 μm to less than 250 μm in thickness. Furthermore, the angle corresponding to the angle as denoted by (α) in FIG. 9 should preferably be in the range from 0 to 45 degrees, or more specifically in the range from 10 to 30 degrees, while the portion corresponding to the length as denoted by (l) in FIG. 9 should preferably be in the range from 2 to 15 mm, or more specifically, in the range from 4 to 8 mm. Alternatively, if each of the cleaning members 16 and 18 is made of a metallic sheet, the thickness of each member is preferably in the range from 30 to 200 μm. More particularly, when the respective cleaning members 16 and 18 are made of thin plates of phosphor bronze each having a thickness of 50 μm, with the angle corresponding to (α) and the length corresponding to (l) being 20 degrees and 5 mm, respectively, the desired cleaning actions of the respective members 16 and 18 have been found to be satisfactory. However, preferred ranges of the angle and length as denoted by (α) and (l), respectively lie in the same ranges as those for the non-metallic members described above even in the case of employment of a cleaning member made of a thin metallic sheet. So far as cleaning performances of the cleaning member and the supplementary cleaning member are concerned, if the cleaning performance of the cleaning member 18 is substantially perfect, the accumulation of developer beneath the leading portion of the supplementary cleaning member 16 is negligible. Such being the case, the respective preferred conditions described in the foregoing are not important and, moreover, the supplementary cleaning member 16 can be omitted if desired.

Still referring to FIG. 7, according to the present invention, there is provided a supporting member 17*a*, which is arranged to support the scraping member 17. Due to the provision of a combination of the scraping member 17 and the supporting member 17*a*, the developer removed from the peripheral surface of the developing sleeve 6 is guided downward, so that the removed developer will not be affected by the magnetic force of the multipolar magnet roller 7 and it is prevented from adhering to the surface of the developing sleeve 6 again. Furthermore, as is clear from FIG. 7, there is provided another supporting member 18*a*, which supports the cleaning member 18 and is capable of guiding the excess developer supplied to the developing sleeve 6 in a downward direction.

Figure 1:
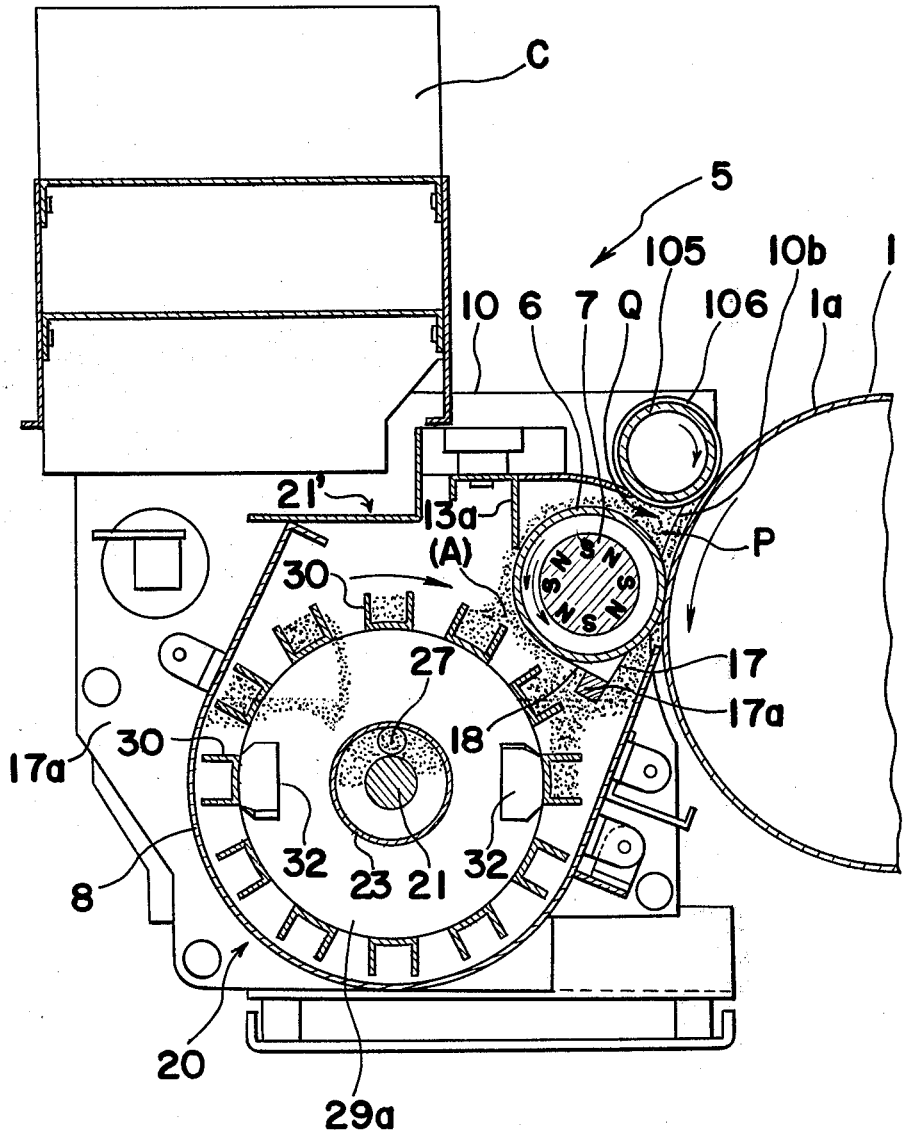
Fig. 1 PRIOR ART
FIG. 1 is a schematic side sectional view of a magnetic brush development apparatus developed previously.
Figure 2:
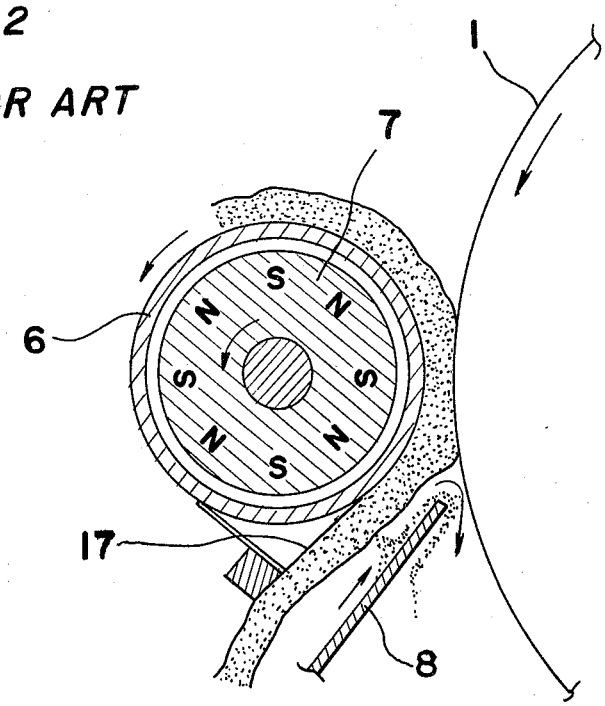
Fig. 2 PRIOR ART
FIG. 2 is a schematic side elevational view showing on an enlarged scale, the construction of a developing section employed in the arrangement of FIG. 1 for explaining the escape of a developer.
Figure 11:
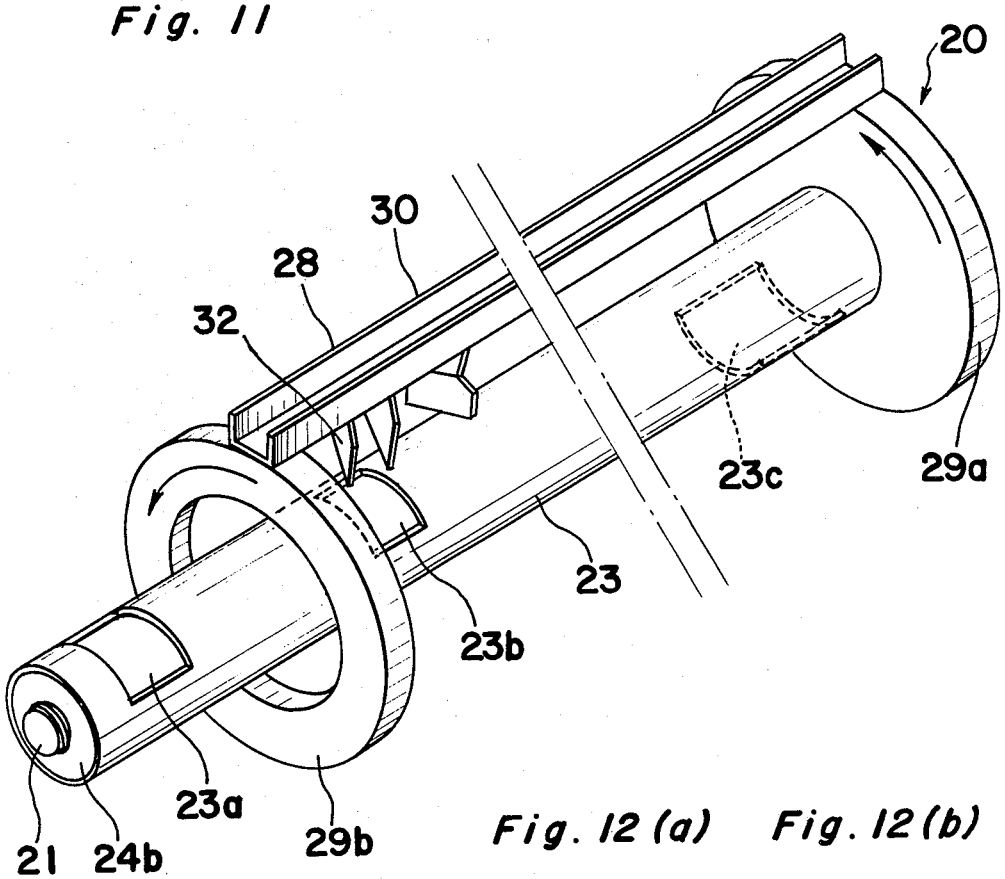
FIG. 11 is a perspective view showing, on an enlarged scale, construction of a stirring device employed in the arrangement of FIG. 5.

Referring also to FIGS. 5, 10 and 11, the developing material stirring device 20 generally includes a rotary shaft 21 extending axially in the developing material storage tank or the casing 8, rotary discs 29*a* and 29*b* mounted on the shaft 21 and constituting a bucket-roll member 28 as will be specifically described later, a plurality of trough-like members 30 each having a U-shaped cross section and axially disposed at regular intervals around the peripheral edges of the rotary discs 29*a* and 29*b* in a paddle wheel-like configuration as shown, a plurality of plate-like members 32 secured to inner surfaces of the corresponding trough-like members 30, a cylinder member 23 partially surrounding the rotary shaft 21, and a coil spring 27 spirally wound around the rotary shaft 21 within the cylinder member 23 so as to function as a developing material stirring and feeding member. The rotary shaft 21 is rotatably supported at its one end on the side wall 10*a* of the developing apparatus 5 in a bearing 22 while the other end of the shaft 21 is also rotatably journalled in a bearing 24*b* provided at one end of the cylinder member 23 extending through the other side wall 10*b* of the developing apparatus 5, and at the extreme end of the shaft 21 extending through the side wall 10*b* there is secured a gear 25 for connecting the shaft 21 to a suitable driving means (not shown). The cylinder member 23 has three square openings 23*a*, 23*b* and 23*c* formed in spaced relation in the outer periphery thereof as in most clearly seen in FIG. 11, and is fixedly supported by a fixed bearing 26 mounted in the side wall 10*b* to surround the rotary shaft 21, while the bearings 24*a* and 24*b* provided at opposite ends of the cylinder member 23 rotatably support the rotary shaft 21. The opening 23*a* is formed in the portion of the cylinder member 23 extending out of the side wall 10*b*, i.e., on the outside of the developing apparatus 5 so as to be directed upward to receive fresh developer to be supplied from a dispenser C (FIG. 1) or used developer collected from the surface of the photoreceptive drum 1 with the help of the developer recycling apparatus (not shown). The other openings 23*b* and 23*c* are formed in a portion of the cylinder member 23 housed in the developing apparatus 5 and adjacent to the rotary discs 29*a* and 29*b* so as to be directed upwardly and downwardly as shown in FIG. 11. It is to be noted here that the number of the openings may be further increased if necessary. The coil spring 27 spirally wound around the rotary shaft 21 extends the whole length of the interior of the cylinder member 23 and has the opposite ends thereof secured to the rotary shaft 21, and is rotated simultaneously with the rotary shaft 21 upon clockwise rotation of the rotary shaft 21 in FIG. 5 so as to move the developer in the axial direction or leftward in FIG. 10, while stirring the developer in the direction of its rotation within the cylinder member 23.

The rotary disc 29*a* is fixed at the one end of the rotary shaft, while the other rotary disc 29*b* is rotatably supported on the fixed bearing 26 secured in the side wall 10*b* of the developing apparatus 5 with a gap 31 between the disc and the bearing, with trough-like members 30 being axially disposed in spaced and parallel relation to each other at regular intervals around the peripheral edges of the rotary discs 29*a* and 29*b*. The gap 31 is provided so that undesirable jamming of the developer will not be brought about between respective circumferences of the rotary disc 29*a* and the fixed bearing 26, which often brings the developing material stirring device 20 to an undesirable operating condition.

Figure 12:
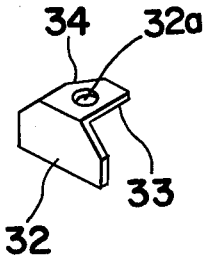
FIG. 12(*a*) is a perspective view showing a plate-like member employed in the stirring device of FIG. 5.
Figure 12:
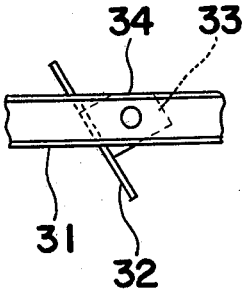

Referring to FIGS. 12(*a*) and 12(*b*), each of the plate members 32 has a bent or folded portion 33 laterally extending therefrom, and has an opening 32*a* therein and a cut off portion 34 at one corner. The plate members 32 are secured, by the bent portion 33 thereof, to the inner surfaces of the trough-like members 30 by a number of screws (not shown) through the opening 32*a* as shown in FIG. 11 so as to be suitably inclined or directed slantwise with respect to the rotary shaft 21, and are rotated as the trough-like members 30 are rotated together with the rotary discs 29*a* and 29*b* following the rotation of the rotary shaft 21 in the clockwise direction in FIG. 5 for causing the developer to move in the axial direction, i.e., in the rightward direction in FIG. 10 according to the angle of inclination thereof, while agitating the developer in the direction of rotation at the outside of the cylinder member 23. It is to be noted here that, by securing the plate members 32 to the trough-like members 30 with the edges of the cut portions 34 of the bent portions 33 aligned with the corresponding edges of the members 31 as shown in FIG. 12(*b*), the plurality of the plate members 32 can be secured to the trough-like members 30 at a predetermined angle of inclination. The plate member which is located above the opening 23*b* is secured to the trough-like members 30 with the angle reversed in comparison with those of the other plate member, so that the developer is properly introduced into the opening 23*b*.

By the above arrangement, developer newly supplied from the developing material supplying device C (FIG. 1) into the opening 23*a* of the cylinder member 23 is transported leftward in FIG. 10 while being stirred within the cylinder member 23 in the direction of rotation by the coil spring 27 rotated in synchronization with the rotary shaft 21, and is led out of the cylinder member 23 through the opening 23*c* to be moved rightward in FIG. 5, while being agitated in the direction of rotation at the outside of the cylinder member 23 rotating in synchronization with the rotation of the rotary shaft 21, during which time part of the developer is scooped up by the trough-like members 30 to be further transported up to region A in FIG. 5. The developer is carried over the peripheral surface of the developing sleeve 6 in the clockwise direction by the action of the multipolar magnet member 7 for developing the electrostatic latent image formed on the surface 1*a* of the photoreceptive drum 1 into a visible image. Meanwhile, the developer which is not scooped up by the trough-like members 30 is moved rightward, while being stirring by the plate members 32 so as to again enter the interior of the cylinder member 23 through the opening 23*b*.

In the following, further improvements especially in the overall control of subsystems including the developing apparatus 5 and constituting the electrophotographic copying machine are detailed.

In the dry process developing apparatus wherein the developer is to be transported to the developing station with the help of the simultaneous rotational movements of the developing sleeve 6 together with the multipolar magnet member 7, thereby to develop the electrostatic latent image formed on the photoreceptive drum 1 into a visible image, the corona charger 900 is conventionally positioned to electrically charge a portion of the photoreceptive peripheral surface which is somewhat longer than that to be required for the image exposure. Accordingly, either a portion ahead of or behind the portion necessary for the image exposure on the photoreceptive drum 1 is desirably charged, whereby these portions successively have developer adhered thereto unless appropriate precautions are taken in advance. However, as a matter of fact, singe the real exposure is arranged to start before the image exposure and to finish a little later on the image exposure area, the respective unnecessarily charged portions can be electrically removed by light reflected from a white rear surface of a manuscript holding cover 200*a*. Even with such a pre- and post-exposure arrangement, the electrical potential of the respective unnecessarily charged portions is not completely removed although it is somewhat reduced, and thus adhesion of some developer is not avoidable. To overcome the problem concerning the adhesion mentioned above, the respective rotational movements of the developing sleeve 6 and the multipolar magnet member 7 can be started in synchronization with the start of the electrostatic latent image, and the movements described above being prevented soon after the end portion of the electrostatic latent image has passed the station described above. However, not only is the above-mentioned precise control itself quite difficult, but also the leading portion of the electrostatic latent image will not be well developed, even if the above-mentioned control is accomplished well. Moreover, as described in the foregoing, owing to the fact that the present developer comprising non-magnetizable insulating particles and magnetizable particles having a high electro-resistivity is easily coagulated so as to be solidified, the developer retained on the developing sleeve 6 should be removed therefrom soon after the end of the developing process, which restricts the above-mentioned control.

Therefore, according to the present invention, for starting simultaneous movement of the developing sleeve 6 together with multipolar magnet member 7, the actuation described above is carried out such that the developer to be transported by the simultaneous movement has already been transported to the developing station at the instant when the leading portion of the electrostatic latent image reaches the station, while the impression of the biasing electric potential on the developing sleeve 6 by the biasing voltage source (V) has started at the time when the forward portion of electrostatically charged image is to reach the station, or more specifically, the forward portion which has been electrically charged is to start contacting the developer. On the contrary, during the stopping of developing, soon after the trailing portion of the electrostatic latent image passes through the developing station, although the rotational movement of the multipolar magnet member 7 is stopped, the rotational movement of the developing sleeve 6 is continued so that the developer remaining on the developing sleeve 6 is removed, and the developing action is stopped for a predetermined time interval. More specifically, the impression of the biasing electrical potential is to be interrupted, soon after the trailing portion of the electrically charged image passes through the developing station. However, if a non-electrically charged portion on the photoreceptor surface is brought into a non-contacting condition with respect to the developer, the biasing electrical potential need not be interrupted.

Figure 13:
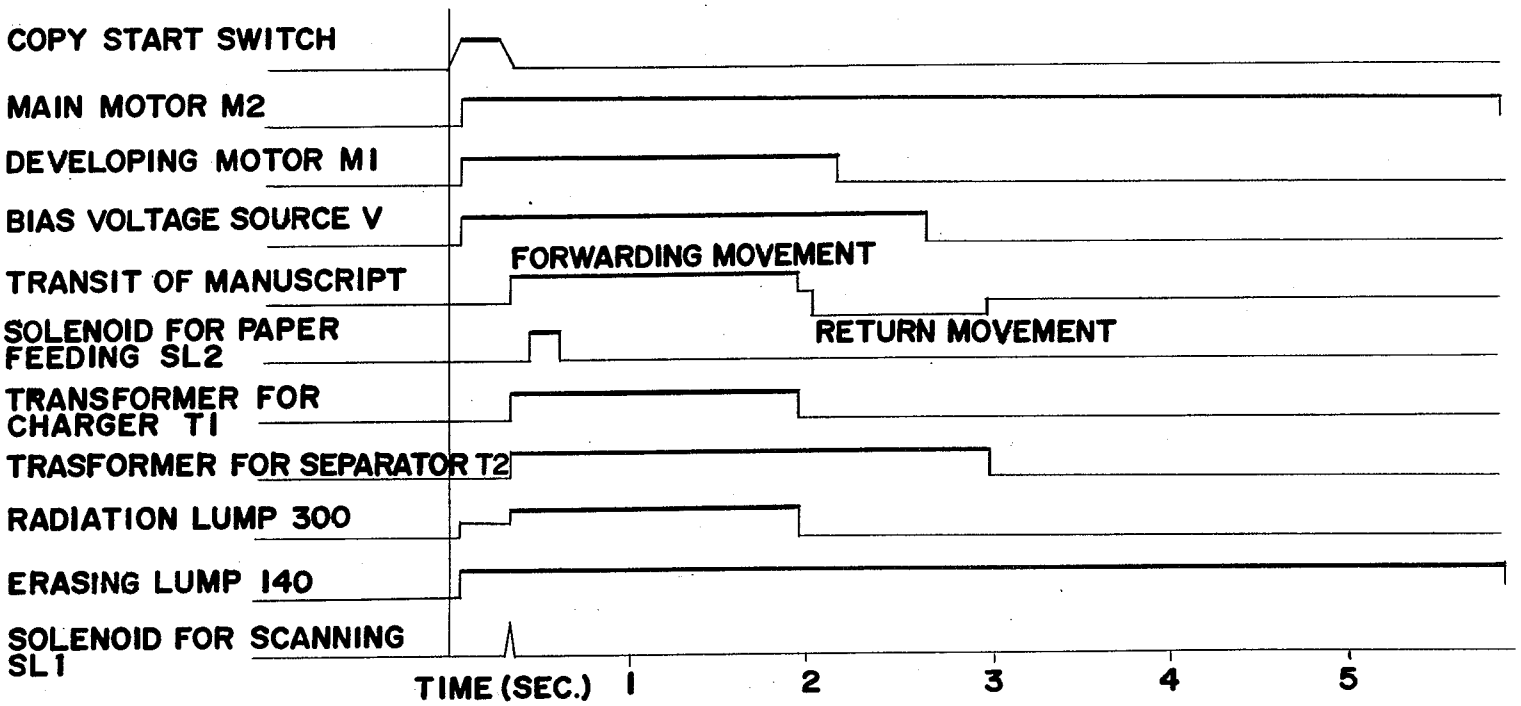
FIG. 13 is a time-sequential diagram, and particularly shows the details of the control of the magnetic brush development apparatus according to one preferred embodiment of the present invention.

Referring now to FIG. 13, there is shown a time chart, which sets forth details of the above-described control of the developing apparatus according to the present invention. For carrying out a copying process, the original to be copied is first laid upon the transparent glass plate 200 and then is covered by the manuscript holding cover 200*a*, while the copy paper (P) selected according to the size of the original, is set in the cassette 150. Upon the completion of actuation of the print switch or the copy start switch (not shown here), a main motor (M2), a developing motor (M1), the biasing voltage source (V), the exposure source lamp (3) and the electrostatic erasing lamp 140 are all simultaneously switched to their respective ON-modes. Following the starting of the main motor (M2), not only are the respective rotational movements of the constituents of the mixing system 20 including the rotary disc 29*b* and the blade member 19 started by the rotational movement of the rotary shaft 21, but also the developing sleeve 6 and the copy paper transporting system including the photoreceptive drum 1, the transporting roller 170, the transporting belt 180, the heating roller 190 and the discharging roller 200 are all simultaneously driven. The developing motor (M1), which is simultaneously actuated in synchronization with the actuation of the main motor (M2), rotates the multipolar magnet member 7 in the same rotational direction as that of the developing sleeve 6 at a much higher rotational speed than that of the developing sleeve 6. Accordingly, the developer successively transported with the trough-like members 30 provided around peripheral edges of the rotary disc 29*b* is appropriately fed to the developing station, or more specifically, the developing position confronting the photoreceptive drum 1, by the respective rotations of the developing sleeve 6 and the multipolar magnet member 7, and the developer is formed into a magnetic brush. The time it takes the developer on the developing sleeve 6 to reach the developing position is arranged to approximately coincide with the arrival of the leading portion of the electrostatic latent image, or the time it takes the developer to reach the developing position may be arranged so that the developer arrives a little earlier than the electrostatic latent image.

Electrically connected to the developing sleeve 6 and arranged to be changed to the ON-mode upon the completion of the starting of the main motor (M2) and the developing motor (M1) is a biasing voltage source (V) for impressing on the developing sleeve 6 an electrical potential, the level of which corresponds to the electrical potential of the portions of the original bearing no image on the surface of the photoreceptor, at the developing position described above, so that the occurrence of excessive development is prevented. As for the reason for starting the impression of the biasing electrical potential on the developing sleeve 6 well before the electrostatic latent image is to reach the developing position, it can not be denied that a peripheral surface portion of the photoreceptor somewhat longer than that to be exposed must be electrically charged in advance as described earlier. Accordingly, under the circumstances as described above, the biasing voltage source (V) is not necessarily electrically actuated at the same instant when both the main motor (M2) together with the developing motor (M1) are electrically actuated, and it is sufficient that the electric actuation of the biasing voltage source be effected at the instant of arrival of the forward portion of the electrostatic latent image or, more particularly, the leading, unnecessarily charged portion of the photoreceptor. However, to prevent an uncharged portion of the photoreceptor surface from having developer adhered thereto, the biasing voltage source (V) is preferably actuated at the instant when the forward unnecessarily charged portion reaches the developing station.

Upon the completion of the actuation of the print switch, although the respective exposure source lamp 300 and erasing lamp 140 are both simultaneously switched into their respective ON-modes, it takes a certain period of time for the exposure source lamp 300 to reach a steady state at which a maximum amount of light is radiated.

After a certain time interval from the actuation of the print switch or more particularly, upon the completion of the counting of a timer means (not shown), the solenoid for scanning (SL1) capable of driving the manuscript tray 100, a transformer (T1) for charging the corona charger 900, respective transformers for the electrostatic transferring charger 110 and the separation charger 120 are all electrically actuated, respectively. At the instant of completion of counting of the timer means in the manner as described above, the exposure source lamp 300 begins to radiate in its maximum radiation condition. Furthermore, as a result of the electrical actuation of the solenoid for scanning (SL1), the transit of the manuscript tray 100 rightward in FIG. 1 according to this embodiment, begins whereby the original is light-scanned. As will be clear from the description, the extent of the transit is somewhat longer than the length of the manuscript or the original to be light-scanned. As described earlier, the corona charger 900 charges the surface of the photoreceptor, the portion to be charged being a little longer than the peripheral surface length of the electric latent image, which is later to be formed on the surface of the photoreceptor and is equivalent to the length of the original to be exposed in a subsequent light exposure station. Therefore, although the respective levels of the electric potentials of the unnecessarily charged forward and rear portions in respect to the portion to be exposed on the photoreceptor are reduced to a certain extent by the light reflected from the white rear surface of the manuscript cover 200*a*, respective residual electric potentials existing there are still sufficient to cause development. However, according to the present invention, even if the abovedescribed forward portion reaches the developing position in synchronization with the developer, the developer does not adhere to the forward portion, due to the fact that the developing sleeve 6 has been kept in an electrically biased condition by the biasing voltage (V). During the transit of the manuscript tray 100, the original is light-scanned, the resulting light image is successively exposed onto the surface of the photoreceptive drum 1 thereby to form the electrostatic latent image thereon. The electrostatic latent image thus formed is developed by frictional contacting with the so-called magnetic brush bristles formed on the developing sleeve 6 at the developing position, with the electrostatic latent image being well developed, due to the arrangement according to the present invention in which the constant biasing electrical potential at least corresponding to the electrical potential of the original portion bearing no image on the surface of the photoreceptor is impressed on the developing sleeve during the developing process as previously described. As far as the copy paper (P) is concerned, in synchronization with the completion of the full transit of the manuscript tray 200, an actuator (not shown here) is actuated thereby to actuate the solenoid for paper feeding (SL2), whereby the copy paper is transported towards the transferring station. The timing of the feed of the copy paper to the transferring station is so arranged that the leading portion of the copy paper (P) is in contact with the leading portion of the image developed on the photoreceptive drum 1 at the transferring station. The image is electrostatically transferred onto the copy paper (P) with the help of the transferring charger 110 and thereafter, is removed from the peripheral surface of the photoreceptive drum 1 by the separating charger 120 and the copy paper bearing an image thereon is transported to the fixing station.

After the transit of the tray 100 is completed and it is stopped at a terminal position of the transit for a moment, the manuscript tray 100 is immediately returned to its initial position, and the transformer (T1) for the charger 900 together with the exposure source lamp 300 are simultaneously switched to their respective OFF-modes. More specifically, the manuscript tray 100 is arranged to move forwardly a longer distance than required for the end portion of the original set in a fixed position on the tray to be light-scanned, so that the complete light scanning of the original image is always accomplished. At the instant the manuscript tray 100 reaches its final position, since the tailing or end portion of the electrostatic latent image has not reached the developing position yet, the multipolar magnet member 7 together with the developing sleeve 6 are being continuously rotated. Soon after the end portion of the electrostatic latent image comes into the developing position mentioned above, the developing motor (V1) is switched to its OFF-mode, so that the multipolar magnet member 7 stops rotating. On the contrary, the developing sleeve 6, which is rotationally driven by the main motor (M2), is kept rotating. Accordingly, the developer remaining on the developing sleeve 6 is rotationally transported counterclockwise, in the opposite rotational direction to that during the steady developing operation as previously described. In association with this counterclockwise rotation, although the unnecessarily charged portion extending on the trailing portion of the electrostatic latent image portion, in which the unnecessary, electrical potential still remains, comes into the developing position, the continuous impression of the bias electrical potential by the biasing voltage (V) in the manner as described earlier prevents this portion from having developer adhered thereto. More specifically, the biasing voltage source (V) is controlled in a manner such that it is kept in its ON-mode until the trailing portion has fully passed through the developing station. For accomplishing this control above, the manuscript tray itself may be arranged to actuate a switching means (not shown) for the biasing voltage source (V) during the course of the returning movement. Alternatively, the control described above may be achieved by causing the copy paper being transported to actuate a switching means provided along the path of the transportation of the copy paper, thereby to cause the biasing voltage source (V) to be switched to its OFF-mode. Moreover, even with respect to the actuation of the developing motor (M1), although its control can be accomplished in the same manner as described above, the time for switching the developing motor (M1) to its OFF-mode is not necessarily coincident with the arrival of the end portion of the electrostatic latent image at the developing point, but can be a little later on.

Accordingly, as is clear from the control as described in the foregoing, since the developer is arranged to electrostatically stick or adhere only onto the main portion of the electrostatic latent image formed on the photoreceptive drum 1, not only is economy in the use of the developer material achieved, but also overload which will otherwise be imposed on the cleaning blade 130, is prevented.

In association with the rapid returning movement of the manuscript tray 100 to its original starting position, switching means (not shown here) are actuated thereby to cause the respective transformers (T1) and (T2) for the transferring charger and the separating charger to be switched to the respective OFF-modes. As previously described, the main motor (M2) is kept rotating, so that the removal of the developer retained on the developing sleeve 6 is almost completely accomplished by means of the cleaning members 16 and 18.

In the case of a continuous copying run, the main motor (M2), the developing motor (M1), the biasing voltage source (V), the transformer (T1) for the charger etc. are all electrically actuated according to the series of timing modes equivalent to those employed for the single copy run, which is specifically shown in FIG. 13 as described in the foregoing.

According to the embodiment as described in the foregoing, although rotation of the multipolar magnet member 7 is stopped either at the instant of the arrival of the end portion of the electrostatic latent image at the developing position or at a time a little prior to the arrival, the control described above is not at all specific. More specifically, in modified embodiments, the rotational speed of the developing speed 6 can be a little higher than a predetermined level or the rotational speed of the multipolar magnet member 7 can, on the contrary, be relatively reduced, whereby the control can be accomplished. According to a still further modified embodiment, the biasing electrical potential provided by the biasing voltage source (V) can be made adjustable if necessary.

In short, according to the present control of the dry process development, in the copying machine which carries out in succession, a step for charging a specific peripheral surface portion on the photoreceptive surface which is somewhat longer than that required for the image exposure by a corona charger, a step of forming the electrostatic latent image on the photoreceptor by exposing it to the image light, a step for developing the electrostatic latent image by magnetic brush development means, thereby to successively electrostatically transfer the developed image onto the copy paper, the improvement of the present invention is characterized by the following arrangements and control procedures. The present developer comprises the non-magnetizable insulating particles and the magnetizable particles having a high electro-resistivity and it is retained on the peripheral surface of the developing sleeve, the rotational speed of the multipolar magnet member rotatably accommodated in the developing sleeve being much higher than that of the developing sleeve so that the developer is transported to the developing station, with the developer being transported taking the form of the magnetic brush thereby to develop the electrostatic latent image at the developing station, while a bias electrical potential relatively equivalent to that of the original portion bearing no image on the photoreceptor which has already been exposed being simultaneously impressed at the developing point. Furthermore, the present invention is further characterized in that not only is the multipolar magnet member not rotated after the end portion of the electrostatic latent image has passed through the developing position, but also the impression of the bias electrical potential is interrupted after the unnecessarily charged portion extending rearwardly from the main portion of the electrostatic latent image on the photoreceptive drum has fully passed through the developing position. By the control arrangement as described, besides obtaining excellent developing results, because the developer is only applied to the main portion of the electrostatic latent image formed on the photoreceptive drum, not only is the amount of developer used kept low, but also overloads on the cleaning and scraping members are prevented. Moreover, as previously described, since the developing sleeve is kept rotating until the developer is fully removed from the peripheral surface of the developing sleeve, undesirable contact of the developer with the photoreceptor surface is also avoided.

When these matters are considered as a whole, the control as described in the foregoing is quite effective although being constituted by a series of simple control steps.

In conclusion, the inventors of the present invention have confirmed the fact that all the effects as described in the foregoing can be obtained, even when a developer is used which comprises non-magnetizable, insulating toner particles each having an average particle-diameter of 3 to 30 μm, and small, magnetizable carrier particles each having an average diameter of 5 to 40 μm and an electro-resistivity of more than $10^{12}$ Ω·cm.

Although the present invention has been fully described by way of example with reference to the accompanying drawings, it is to be noted here that various changes and modification will be apparent to those skilled in the art. Therefore, unless otherwise such changes and modifications depart from the scope of the present invention, they should be construed as being included therein.

What is claimed is:

1. A magnetic brush development apparatus for use in an electrophotographic copying machine for developing an electrostatic latent image, said apparatus being of the type for using a developer which is constituted by non-magnetizable particles and magnetizable particles with the diameters of the respective particles being approximately the same, said apparatus comprising:

a developing casing having a developer powder supply position and a developer powder delivery position at which the developer powder is applied to the latent image;

a developing sleeve rotatably mounted in said developing casing with said positions being spaced around said sleeve, said sleeve being rotatable in a direction for moving the peripheral surface from said delivery position along a delivery path for the developer to said supply position in a direction opposite to the direction of movement of the developer along the delivery path around said sleeve from the supply position to the delivery position;

a multipolar magnet member rotatably accommodated in said developing sleeve, said multipolar magnet member being rotatable in the same direction as said developing sleeve for transporting developing material affected by said magnet member around said sleeve in a direction opposite to the direction of rotation of said sleeve and said magnet member;

driving means connected to said sleeve and to said magnet member for driving said sleeve and said magnet member and driving said magnet member at a much higher speed of rotation than the speed of rotation of said developing sleeve for moving the affected developer along said delivery path;

a least one cleaning member positioned along the portion of the periphery of said sleeve which is moving from said supply position to said delivery position, said cleaning member being urged into contact with the surface of said sleeve and directed in a direction opposite to the direction of rotation of said sleeve for removing part of the developer adhering to said sleeve and which is at most only slightly affected by said magnet member and transported in the direction of rotation of said sleeve; and at least one scraping member positioned along the portion of the periphery of said sleeve which is moving from said supply position to said delivery position and positioned between said cleaning member and said delivery position for scraping the affected developer from said surface of said sleeve, and said scraping member having a forward end portion urged into contact with said surface of said sleeve and directed in the direction of rotation of said developing sleeve, the forward end portion of said scraping member having a resiliency for being lightly pressed against said sleeve and for being movable away from the peripheral surface of the developing sleeve by the remaining slightly affected developer for forming a gap between said peripheral surface of the sleeve and said forward end, whereby the slightly affected developer is passed through said gap and does not accumulate between said scraping member and said sleeve.

2. An apparatus as claimed in claim 1 wherein said scraping member is made of a resilient sheet-like material having a thickness ranging from 30–100 microns, the angle between a tangent to the surface of said developing sleeve and said forward end portion of said scraping member is in the range of from 0–30 degrees and said scraping member has a length from the point of mounting to the said forward end contacting said sleeve which is in the range from 5 to 20 mm.

3. A magnetic brush type development apparatus for use in a device for developing electrostatic latent images by using a developer which is constituted by non-magnetizable particles and magnetizable particles with the respective particle diameters of the respective particles being approximately the same, said device having an electrostatic latent image carrier, said development apparatus comprising:

a developing casing positioned adjacent said electrostatic latent image carrier;

a developing sleeve rotatably mounted in said casing;

a multipolar magnet member rotatably mounted in said developing sleeve and being rotatable at a faster speed than said sleeve for causing the developer to be moved around said sleeve through said casing to said image carrier;

said casing having an inner surface partially enclosing the upper portion of said developing sleeve and having a circular cross-section substantially parallel and spaced from the surface of said developing sleeve to define a magnetic brush accommodating space between said sleeve and said inner surface; and an electrically insulating member on said casing adjacent said image carrier and having a leading edge portion overlapping the end of said inner surface adjacent said image carrier and forming an extension of said inner surface and further being in slidable contact with said image carrier, whereby the magnetic brush formed on said developing sleeve rubs against the inner surface of said casing and said insulating member while moving toward said image carrier, and developer is prevented from escaping between the casing and the image carrier.

4. A magnetic brush type development apparatus for use in a device for developing electrostatic latent images, said device using a magnetic developer, said device having an electrostatic latent image carrier, said development apparatus comprising:

a developing casing positioned adjacent said electrostatic latent image carrier;

a developing sleeve member mounted in said casing, a multipolar magnet member mounted in said developing sleeve member for magnetically attracting the developer to said sleeve member;

means for moving the developer around said sleeve member through said casing to said image carrier;

said casing having an inner surface partially enclosing the upper portion of said developing sleeve member and having a circular cross-section substantially parallel and spaced from the surface of said developing sleeve member to define a magnetic brush accommodating space between said sleeve member and said inner surface; and an electrically insulating member on said casing adjacent said image carrier and having a leading edge portion overlapping the end of said inner surface adjacent said image carrier and forming an extension of said inner surface and further being in slidable contact with said image carrier, whereby the magnetic brush formed on said developing sleeve member rubs against the inner surface of said casing and said insulating member while moving toward said image carrier, and developer is prevented from escaping between the casing and the image carrier.

5. An apparatus as claimed in claim 4 in which the magnetic developer is constituted by insulating particles and magnetizable particles, the diameters of the respective particles being approximately the same.

6. A magnetic brush development apparatus as claimed in claim 3 or 4 in which said insulating member is made of sheet-like elastic insulating material.

7. A magnetic brush development apparatus for use in a device for developing an electrostatic latent image by using a magnetic developer, said apparatus comprising:

a developing casing having a developer powder supply position and a developer powder delivery position at which the developer powder is applied to the latent image;

a developing sleeve member mounted in said developing casing with said positions being spaced around said sleeve member;

a multipolar magnet member accommodated in said developing sleeve for magnetically attracting the developer to said sleeve member;

means for moving the developer around said sleeve member from the supply position to the delivery position;

at least one scraping member positioned along the portion of the periphery of said sleeve member for scraping developer which moves past said delivery position from said surface of said sleeve member; said scraping member having a forward end portion urged into contact with said surface of said sleeve member and directed in the direction of movement of the developer around the sleeve member; and a developer trapping member for trapping the cloud of powder of unused developer which moves past said delivery position, said developer trapping member being between said scraping member and said casing for blocking developing material scattered from the forward end of said scraping member from escaping from said casing and spaced from said sleeve member and casing sufficiently to avoid hindering the movement of developer along said scraping member and the surface of said trapping member which is toward said sleeve member being opposed to the forward end portion of said scrapping member, said trapping member further being positioned out of the path of falling developing material which has been scraped off said developing sleeve member by said scraping member and being spaced from said casing for permitting blocked developing material to flow along the surface of said trapping member facing away from said sleeve.

8. A magnetic brush development apparatus as claimed in claim 7 in which the end portion of said developer trapping member which is facing in the opposite direction to the direction of movement of the affected developer along said developing sleeve is in the shape of a knife edge.

9. A magnetic brush development apparatus as claimed in claim 7 in which said developer trapping member is made of electrically conductive material and is grounded.

10. A magnetic brush development apparatus as claimed in claim 7 in which said developer trapping member is made of electrically conductive material and is electrically insulated from the remainder of said apparatus.

11. A magnetic brush development apparatus as claimed in claim 7 in which said developer trapping member is made of electrically conductive material, and said apparatus further comprises means connected to said developer trapping member for impressing on said developer trapping member a bias potential having a polarity opposite that of the electrostatic latent image.

12. A magnetic brush development apparatus for use in a device for developing an electrostatic latent image by using a developer which is constituted by non-magnetizable particles and magnetizable particles with the diameters of the respective particles being approximately the same, said apparatus comprising:

a developing casing having a developer powder supply position and a developer powder delivery position at which the developer powder is applied to the latent image;

a developing sleeve rotatably mounted in said developing casing with said positions being spaced around said sleeve, said sleeve being rotatable in a direction for moving the peripheral surface from said delivery position along a delivery path for the developer to said supply position in a direction opposite to the direction of movement of the developer along the delivery path around said sleeve from the supply position to the delivery position;

a multipolar magnet member rotatably accommodated in said developing sleeve, said multipolar magnet member being rotatable in the same direction as said developing sleeve;

driving means connected to said sleeve and to said magnet member for driving said sleeve and said magnet member and driving said magnet member at a much higher speed of rotation than the speed of rotation of said developing sleeve for moving the developer along said delivery path;

at least one scraping member positioned along the portion of the periphery of said sleeve which is moving from said supply position to said delivery position for scraping developer which moves past said delivery position from said surface of said sleeve; said scraping member having a forward end portion urged into contact with said surface of said sleeve and directed in the direction of rotation of said developing sleeve; and a developer trapping member for trapping the cloud of powder of unused developer which moves past said delivery position, said developer trapping member being between said scraping member and said casing for blocking developing material scattered from the forward end of said scraping member from escaping from said casing and spaced from said sleeve sufficiently to avoid hindering the movement of developer along said scraping member and the surface of said trapping member which is facing toward said sleeve being opposed to the forward end portion of said scraping member, said trapping member further being positioned out of the path of falling developing material which has been scraped off said developing sleeve by said scraping member and being spaced from said casing for permitting blocked developing material to flow along the surface of said trapping member facing away from said sleeve.

13. A magnetic brush development apparatus for use in a device for developing an electrostatic latent image by using a developer which is constituted by insulating particles and magnetizable particles with the diameters of the respective particles being approximately the same, said apparatus comprising:

a developing casing having a developer powder supply position and a developer powder delivery position at which the developer powder is applied to the latent image;

a developing sleeve rotatably mounted in said developing casing with said positions being spaced around said sleeve, said sleeve being rotatable in a direction for moving the peripheral surface from said delivery position along a delivery path for the developer to said supply position in a direction opposite to the direction of movement of the developer along the delivery path around said sleeve from the supply position to the delivery position;

a multipolar magnet member rotatably accommodated in said developing sleeve, said multipolar magnet member being rotatable in the same direction as said developing sleeve for transporting developing material affected by said magnet member around said sleeve in a direction opposite to the direction of rotation of said sleeve and said magnet member;

driving means connected to said sleeve and to said magnet member for driving said sleeve and said magnet member and driving said magnet member at a much higher speed of rotation than the speed of rotation of said developing sleeve for moving the affected developer along said delivery path;

at least one cleaning member position along the portion of the periphery of said sleeve which is moving from said supply position to said delivery position urged into contact with the surface of said sleeve and directed in a direction opposite to the direction of rotation of said sleeve for removing part of the developer adhering to said sleeve and which is at the most only slightly affected by said magnet member and transported in the direction of rotation of said sleeve; and at least one scraping member positioned along the portion of the periphery of said sleeve which is moving from said supply position to said delivery position and positioned between said cleaning member and said delivery position for scraping the affected developer from said surface of said sleeve, said scraping member having a forward end portion urged into contact with said surface of said sleeve and directed in the direction of rotation of said developing sleeve, the forward end portion of said scraping member having a resiliency for being only lightly pressed against said sleeve for being movable away from the peripheral surface of the developing sleeve by the remaining slightly affected developer for forming a gap between said peripheral surface of the sleeve and said forward end, whereby the slightly affected developer is passed through said gap and does not accumulate between said scraping member and said sleeve.

14. A magnetic brush development apparatus as claimed in claim 13, wherein said driving means comprises means for discontinuing the drive only of said multipolar magnet member for at least a certain predetermined period in the course of the non-developing part of the operation of said device.

15. An apparatus as claimed in claim 14 wherein said scraping member is made of a resilient sheet-like material having a thickness ranging from 30–100 microns, the angle between a tangent to the surface of said developing sleeve and said forward end portion of said scraping member is in the range of from 0–30 degrees and said scraping member has a length from the point of mounting to the said forward end contacting said sleeve which is in the range of from 5 to 20 mm.

* * * * *